US008346544B2

(12) United States Patent
Manjunath et al.

(10) Patent No.: US 8,346,544 B2
(45) Date of Patent: Jan. 1, 2013

(54) SELECTION OF ENCODING MODES AND/OR ENCODING RATES FOR SPEECH COMPRESSION WITH CLOSED LOOP RE-DECISION

(75) Inventors: Sharath Manjunath, San Diego, CA (US); Ananthapadmanabhan Aasanipalai Kandhadai, San Diego, CA (US); Eddie L. T. Choy, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1340 days.

(21) Appl. No.: 11/625,802

(22) Filed: Jan. 22, 2007

(65) Prior Publication Data

US 2007/0244695 A1 Oct. 18, 2007

Related U.S. Application Data

(60) Provisional application No. 60/760,799, filed on Jan. 20, 2006, provisional application No. 60/762,010, filed on Jan. 24, 2006.

(51) Int. Cl.
*G10L 19/00* (2006.01)

(52) U.S. Cl. ..... 704/219; 704/220; 704/221; 704/230

(58) Field of Classification Search ..... 704/219, 704/230, 220, 221, 200
See application file for complete search history.

(56) References Cited

U.S. PATENT DOCUMENTS 4,901,307 A 2/1990 Gilhousen et al.
5,103,459 A 4/1992 Gilhousen et al.
5,414,796 A 5/1995 Jacobs et al.
5,495,555 A 2/1996 Swaminathan
5,727,123 A 3/1998 McDonough et al.
5,737,484 A * 4/1998 Ozawa ..... 704/219
5,784,532 A 7/1998 McDonough et al.
5,884,253 A 3/1999 Kleijn
5,911,128 A 6/1999 DeJaco
5,926,786 A 7/1999 McDonough et al.
6,012,026 A 1/2000 Taori et al.
6,167,079 A 12/2000 Kinnunen et al.
6,292,777 B1 * 9/2001 Inoue et al. ..... 704/230
6,330,532 B1 12/2001 Manjunath et al.
6,438,518 B1 8/2002 Manjunath et al.
6,449,592 B1 9/2002 Das (Continued)

OTHER PUBLICATIONS

3GPP TS 26.093 V6.0.0 (Mar. 2003), ETSI TS 126 093 V6.0.0. "Source Controlled Rate operation" Mar. 2003, Release 6.

(Continued)

*Primary Examiner* — Qi Han
(74) *Attorney, Agent, or Firm* — Todd Marlette; Heejong Yoo

(57) ABSTRACT

In a device configurable to encode speech performing an closed loop re-decision may comprise representing a speech signal by amplitude components and phase components for a current frame and a past frame. In a first closed loop stage, a first set of compressed components and a first set of uncompressed components for a current frame may be generated. A first set of features may be generated by comparing current and past frame amplitude and/or phase components. In a second closed loop stage, a second set of compressed components for the current frame may be generated by compressing the first set of compressed components and compressing the first set of uncompressed components. Generation of a second set of features may be based on the second set of compressed components from the current frame and a combination of amplitude and/or phase components from the past frame.

46 Claims, 17 Drawing Sheets

U.S. PATENT DOCUMENTS

| | | | | |
|---|---|---|---|---|
| 6,456,964 | B2 | 9/2002 | Manjunath et al. | |
| 6,463,097 | B1 | 10/2002 | Held et al. | |
| 6,463,407 | B2 | 10/2002 | Das et al. | |
| 6,475,245 | B2 | 11/2002 | Gersho et al. | |
| 6,477,502 | B1 | 11/2002 | Ananthpadmanabhan et al. | |
| 6,577,871 | B1 | 6/2003 | Budka et al. | |
| 6,584,438 | B1 * | 6/2003 | Manjunath et al. | 704/228 |
| 6,625,226 | B1 | 9/2003 | Gersho et al. | |
| 6,678,649 | B2 | 1/2004 | Manjunath | |
| 6,691,084 | B2 | 2/2004 | Manjunath et al. | |
| 6,735,567 | B2 | 5/2004 | Gao et al. | |
| 6,754,630 | B2 | 6/2004 | Das et al. | |
| 6,785,645 | B2 | 8/2004 | Khalil et al. | |
| 7,054,809 | B1 | 5/2006 | Gao | |
| 7,120,447 | B1 | 10/2006 | Chheda et al. | |
| 7,146,174 | B2 | 12/2006 | Gardner et al. | |
| 7,474,701 | B2 | 1/2009 | Boice et al. | |
| 7,542,777 | B2 | 6/2009 | Haim | |
| 7,613,606 | B2 | 11/2009 | Makinen | |
| 8,032,369 | B2 | 10/2011 | Manjunath et al. | |
| 8,090,573 | B2 | 1/2012 | Manjunath et al. | |
| 2001/0018650 | A1 | 8/2001 | DeJaco | |
| 2002/0007273 | A1 | 1/2002 | Chen | |
| 2002/0115443 | A1 | 8/2002 | Freiberg et al. | |
| 2002/0147022 | A1 | 10/2002 | Subramanian et al. | |
| 2003/0006916 | A1 | 1/2003 | Takamizawa | |
| 2003/0014242 | A1 | 1/2003 | Ananthpadmanabhan et al. | |
| 2004/0137909 | A1 | 7/2004 | Gerogiokas et al. | |
| 2004/0176951 | A1 | 9/2004 | Sung et al. | |
| 2004/0213182 | A1 | 10/2004 | Huh et al. | |
| 2005/0055203 | A1 | 3/2005 | Makinen et al. | |
| 2005/0111462 | A1 | 5/2005 | Walton et al. | |
| 2005/0265399 | A1 | 12/2005 | El-Maleh et al. | |
| 2005/0285764 | A1 | 12/2005 | Bessette et al. | |
| 2006/0212594 | A1 | 9/2006 | Haner et al. | |
| 2007/0192090 | A1 | 8/2007 | Shahidi | |
| 2008/0262850 | A1 * | 10/2008 | Taleb et al. | 704/500 |

OTHER PUBLICATIONS

3GPP2 C.S0014-0 Version 1.0 Enhanced Variable Rate Codec (EVRC), Dec. 1999, p. 4.24-426, p. 5.1-5.2.

3rd Generation Partnership Project 2 ("3GPP2"), Enhanced Variable Rate Codec, Speech Service Option 3 for Wideband Spread Spectrum Digital Systems, 3GPP2 C.S0014-A ver. 1.0, Apr. 2004, Ch. 5, pp. 5-1 to 5-12.

Ahmadi et al. "Wideband Speech Coding for CDMA2000@ Systems" 2003.

Akhavan et al. "QoS Provisioning for Wireless ATM by Variable-Rate Coding" 1999.

Chawla et al. "QoS Based Scheduling for Incorporating Variable Rate Coded Voice in Bluetooth" 2001.

Das, A et al.: Multimode Variable Bit Rate Speech Coding: An Efficient Paradigm for High-Quality Low-Rate Representation of Speech Signal, 1999 IEEE International Conference on Acoustics, Speech, and Signal Processing, vol. 4, Mar. 15-19, 1999, pp. 2307-2310.

Cohen, Edith et al., "Multi-rate Detection for the IS-95 CDMA Forward Traffic Channels", Proc. of IEEE Globecom, 1995, pp. 1789-1793.

Eleftheriadis et al. "Meeting Arbitrary QoS Constraints Using Dynamic Rate Shaping of Coded Digital Video" 1995.

El-Ramly et al. "A Rate-Determination Algorithm for Variable-Rate Speech Coder" IEEE, I 2004.

George et al. "Variable Frame Rate parameter Encoding via Adaptive Frame Selection using Dynamic Programming" IEEE, 1996.

Le Boudec, Jean-Yves "Rate adaptation, Congestion Control and Fairness: A Tutorial" Dec. 2000.

Jelinek, M at al: "On the Architecture of the CDMA2000—Variable-rate Multimode Wideband (VMR-WB) Speech Coding Standard," Acoustics, Speech, arid Signal Processing, 2004. Proceedings, (ICASSP '04). IEEE international Conference on Montreal, Quebec:, Canada May 17-21, 2004, Piscataway, NJ, USA, IEEE, vol. 1, May 17, 2004, pp. 281-284, P01071 7620. ISBN: 0-7803-8484-9.

Kumar et al. "High Data-Rate Packet Communications for Cellular Networks Using CDMA: Algorithms and Performance", IEEE Journal on Selected Areas in Communications, vol. 17, No. 3, Mar. 1999, pp. 472-492.

Recchione M C: "The Enhanced Variable Rate Coder: Toll Quality Speech for CDMA" International Journal of Speech Technology, Kluwer, Dordrecht NL, vol. 2, No. 4, 1999, pp. 305-315, XP0010115041.

Greer, S. Craig, Standardization of the Selectable Mode Vocoder, IEEE Acoustics, Speech, and Signal Processing, 2001, 0-7803-7041-4/01, pp. 953-956.

W. Bastiaan Kleijn & Wolfgang Granzow, Methods for Waveform Interpolation in Speech Coding, in Digital Signal Processing 215-230, (1991).

L.B. Rabiner & R.W. Schafer, Digital Processing of Speech Signals 396-453 (1978).

Enhanced Variable Rate Codec, Speech Service Option 3 and 68 for Wideband Spread Spectrum Digital Systems, May 2006.

* cited by examiner

143

```
If (operating_anchor_point == 0)
 {
    If (speech mode is EQUAL to UNVOICED) {
          patterncount = patterncount + c1 x p_fraction

          If (patterncount > c2) {
             change encoding mode for frame to full-rate CELP
             patterncount = patterncount – c2
          }
    }
}

If (operating_anchor_point == 1) {
    If (speech mode is EQUAL to voiced AND SEM is EQUAL to PPP AND SER is EQUAL to quarter-rate) {
          patterncount = patterncount + c1 x p_fraction

          If (patterncount > c2) {
             change encoding mode for frame to full-rate CELP
             patterncount = patterncount – c2
          }
    }
}

If (operating_anchor_point == 2) {
    If (speech mode is EQUAL to voiced AND SEM is EQUAL to PPP AND SER is EQUAL to quarter-rate AND the last frame was Q-PPP) {
          patterncount = patterncount + c1 x p_fraction

          If (patterncount > c2) {
             change encoding mode for frame to full-rate CELP
             patterncount = patterncount – c2
          }
    }
}
```

FIG.10

136B

```
If (operating_anchor_point == 0)
 {
     If (speech mode is EQUAL to UNVOICED) {
            patterncount  = patterncount + c1 x p_fraction

            If (patterncount > c2) {
              change encoding mode for frame to full-rate CELP
              patterncount  = patterncount – c2
            }
     }
}

If (operating_anchor_point == 1) {
     If (speech mode is EQUAL to voiced AND SEM is EQUAL to PPP AND SER is EQUAL to quarter-rate OR ol_re-decision is true OR cl_re-decision is
true) {
            patterncount  = patterncount + c1 x p_fraction

            If (patterncount > c2) {
              change encoding mode for frame to full-rate CELP
              patterncount  = patterncount – c2
            }
     }
}

If (operating_anchor_point == 2) {
     If (speech mode is EQUAL to voiced AND SEM is EQUAL to PPP AND SER is EQUAL to quarter-rate AND the last frame was Q-PPP OR ol_re-
     decision is true OR cl_re-decision is true)
     {
            patterncount  = patterncount + c1 x p_fraction

            If (patterncount > c2) {
              change encoding mode for frame to full-rate CELP
              patterncount  = patterncount – c2
            }
     }
}
```

FIG.17

SELECTION OF ENCODING MODES AND/OR ENCODING RATES FOR SPEECH COMPRESSION WITH CLOSED LOOP RE-DECISION

RELATED APPLICATIONS

This application claims benefit of U.S. Provisional Application No. 60/760,799, filed Jan. 20, 2006, entitled "METHOD AND APPARATUS FOR SELECTING A CODING MODEL AND/OR RATE FOR A SPEECH COMPRESSION DEVICE." This application also claims benefit of U.S. Provisional Application No. 60/762,010, filed Jan. 24, 2006, entitled "ARBITRARY AVERAGE DATA RATES FOR VARIABLE RATE CODERS."

CROSS-REFERENCES TO RELATED APPLICATIONS

This patent application is related to the U.S. patent application entitled "SELECTION OF ENCODING MODES AND/OR ENCODING RATES FOR SPEECH COMPRESSION WITH OPEN LOOP RE-DECISION," having Ser. No. 11/625,797, co-filed on Jan. 22, 2007. This patent is also related to the U.S. patent application entitled "ARBITRARY AVERAGE DATA RATES FOR VARIABLE RATE CODERS," having Ser. No. 11/625,788, co-filed on Jan. 22, 2007.

TECHNICAL FIELD

The present disclosure relates to signal processing, such as the coding of audio input in a speech compression device.

BACKGROUND

Transmission of voice by digital techniques has become widespread and incorporated into a wide range of devices, including, wireless communication devices, personal digital assistants (PDAs), laptop computers, desktop computers, mobile and or satellite ratio telephones, and the like. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) may be required to achieve a speech quality of conventional analog telephone. However, through the use of speech analysis, followed by an appropriate coding, transmission, and resynthesis at the receiver, a significant reduction in the data rate can be achieved. Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307.

The IS-95 standard subsequently evolved into "3G" systems, such as cdma2000 and WCDMA, which provide more capacity and high speed packet data services. Two variations of cdma2000 are presented by the documents IS-2000 (cdma2000 1xRTT) and IS-856 (cdma2000 1xEV-DO), which are issued by TIA. The cdma2000 1xRTT communication system offers a peak data rate of 153 kbps whereas the cdma2000 1xEV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214.

Devices that employ techniques to compress speech by extracting parameters that relate to a model of human speech generation are called speech coders. Speech coders typically comprise an encoder and a decoder. Speech codecs are a type of speech coder and do comprise an encoder and a decoder. The encoder divides the incoming speech signal into blocks of time, or analysis frames. The duration of each segment in time (or "frame") is typically selected to be short enough that the spectral envelope of the signal may be expected to remain relatively stationary. For example, one typical frame length is twenty milliseconds, which corresponds to 160 samples at a typical sampling rate of eight kilohertz (kHz), although any frame length or sampling rate deemed suitable for the particular application may be used.

The encoder analyzes the incoming speech frame to extract certain relevant parameters, and then quantizes the parameters into binary representation, i.e., to a set of bits or a binary data packet. The data packets are transmitted over the communication channel (i.e., a wired and/or wireless network connection) to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

A well-known time-domain speech coder is the Code Excited Linear Predictive (CELP) coder described in L. B. Rabiner & R. W. Schafer, *Digital Processing of Speech Signals* 396-453 (1978). In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796.

Time-domain coders such as the CELP coder typically rely upon a high number of bits, $N_0$, per frame to preserve the accuracy of the time-domain speech waveform. Such coders typically deliver excellent voice quality provided that the number of bits, $N_0$, per frame is relatively large (e.g., 8 kbps or above). However, at low bit rates (e.g., 4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

An alternative to CELP coders at low bit rates is the "Noise Excited Linear Predictive" (NELP) coder, which operates under similar principles as a CELP coder. However, NELP coders use a filtered pseudo-random noise signal to model speech, rather than a codebook. Since NELP uses a simpler model for coded speech, NELP achieves a lower bit rate than CELP. NELP is typically used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system. Some speech codecs are referred to as vocoders. Vocoders comprise an encoder and a decoder for compressing speech.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal. An exemplary PWI, or PPP, speech coder is described in U.S. Pat. No. 6,456,964, entitled PERIODIC SPEECH CODING. Other PWI, or PPP, speech coders are described in U.S. Pat. No. 5,884,253 and W. Bastiaan Kleijn & Wolfgang Granzow, *Methods for Waveform Interpolation in Speech Coding*, in *Digital Signal Processing* 215-230 (1991).

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. Pat. No. 6,691,084, entitled VARIABLE RATE SPEECH CODING. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (non-speech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures.

As an illustrative example of multimode coding, a variable rate coder may be configured to perform CELP, NELP, or PPP coding of audio input according to the type of speech activity detected in a frame. If transient speech is detected, then the frame may be encoded using CELP. If voiced speech is detected, then the frame may be encoded using PPP. If unvoiced speech is detected, then the frame may be encoded using NELP. However, the same coding technique can frequently be operated at different bit rates, with varying levels of performance. Different coding techniques, or the same coding technique operating at different bit rates, or combinations of the above may be implemented to improve the performance of the coder.

Skilled artisans will recognize that increasing the number of encoder/decoder modes will allow greater flexibility when choosing a mode, which can result in a lower average bit rate. The increase in the number of encoder/decoder modes will correspondingly increase the complexity within the overall system. The particular combination used in any given system will be dictated by the available system resources and the specific signal environment.

In spite of the flexibility offered by the new multimode coders, the current multimode coders are still reliant upon coding bit rates that are fixed. In other words, the speech coders are designed with certain pre-set coding bit rates, which result in average output rates that are at fixed amounts.

Accurate ways to decide if the current encoding mode and/or encoding rate may provide good sound quality before the user hears the reconstructed speech signal has been a challenge in speech encoders for many years. A robust solution is desired.

SUMMARY

In a device configurable to encode speech performing an closed loop re-decision may comprise representing a speech signal by amplitude components and phase components for a current frame and a past frame. In a first closed loop stage, a first set of compressed components and a first set of uncompressed components for a current frame may be generated. A first set of features may be generated by comparing current and past frame amplitude and/or phase components. In a second closed loop stage, a second set of compressed components for the current frame may be generated by compressing the first set of compressed components and compressing the first set of uncompressed components. Generation of a second set of features may be based on the second set of compressed components from the current frame and a combination of amplitude and/or phase components from the past frame.

These and other techniques described herein may be implemented in a device in hardware, software, firmware, or any combination thereof. If implemented in software, the techniques may be directed to a computer readable medium comprising program code, that when executed, performs one or more of the techniques described herein. Additional details of various configurations are set forth in the accompanying drawings and the description below. Other features, objects and advantages will become apparent from the description and drawings, and from the claims.

Figure 4:
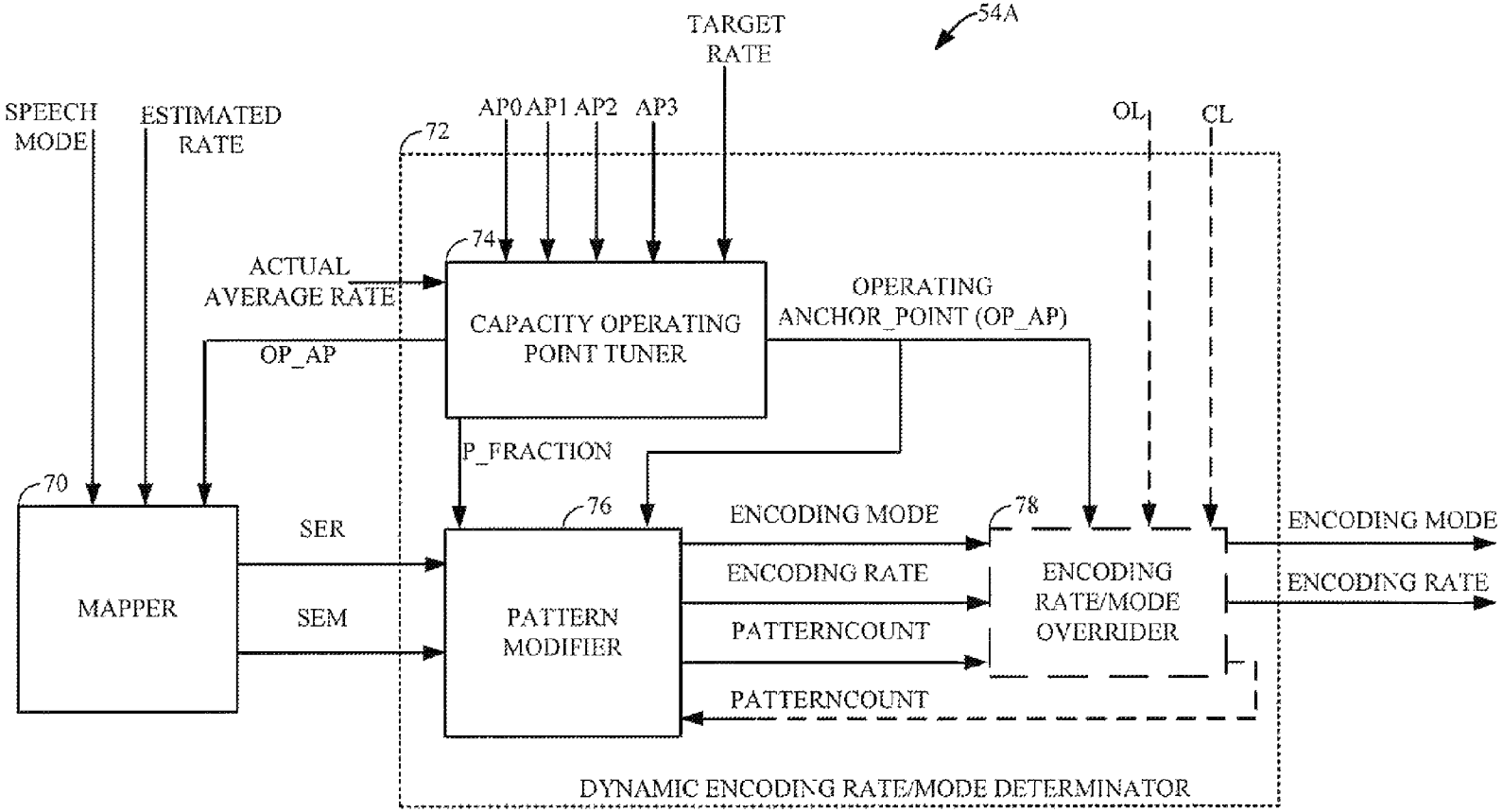

An exemplary encoding rate/mode determinator 54A is illustrated in FIG. 4.

Figure 5:
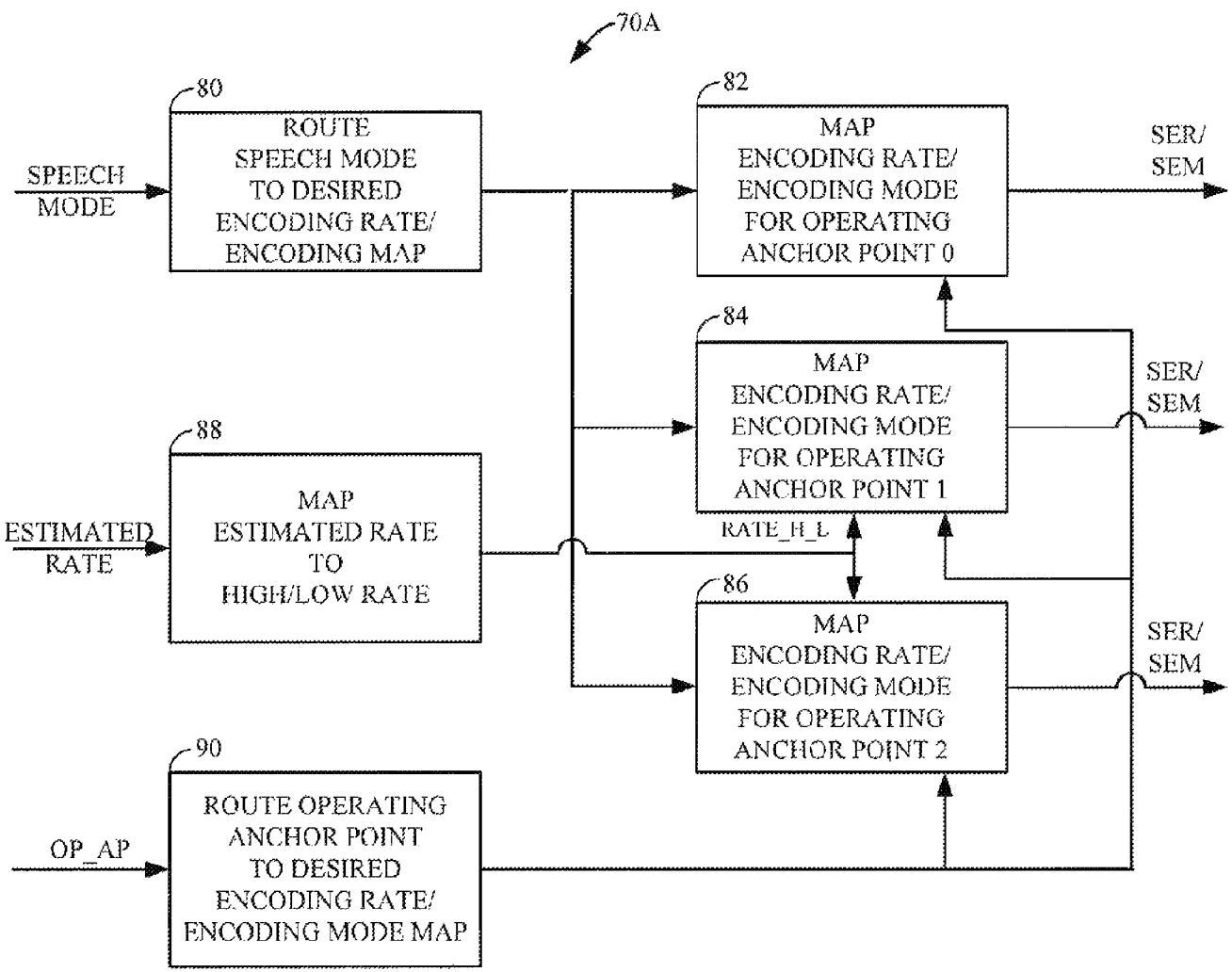

FIG. 5 is an illustration of a method to map speech mode and estimated rate to a suggested encoding mode (sem) and suggested encoding rate (ser).

Figure 6:
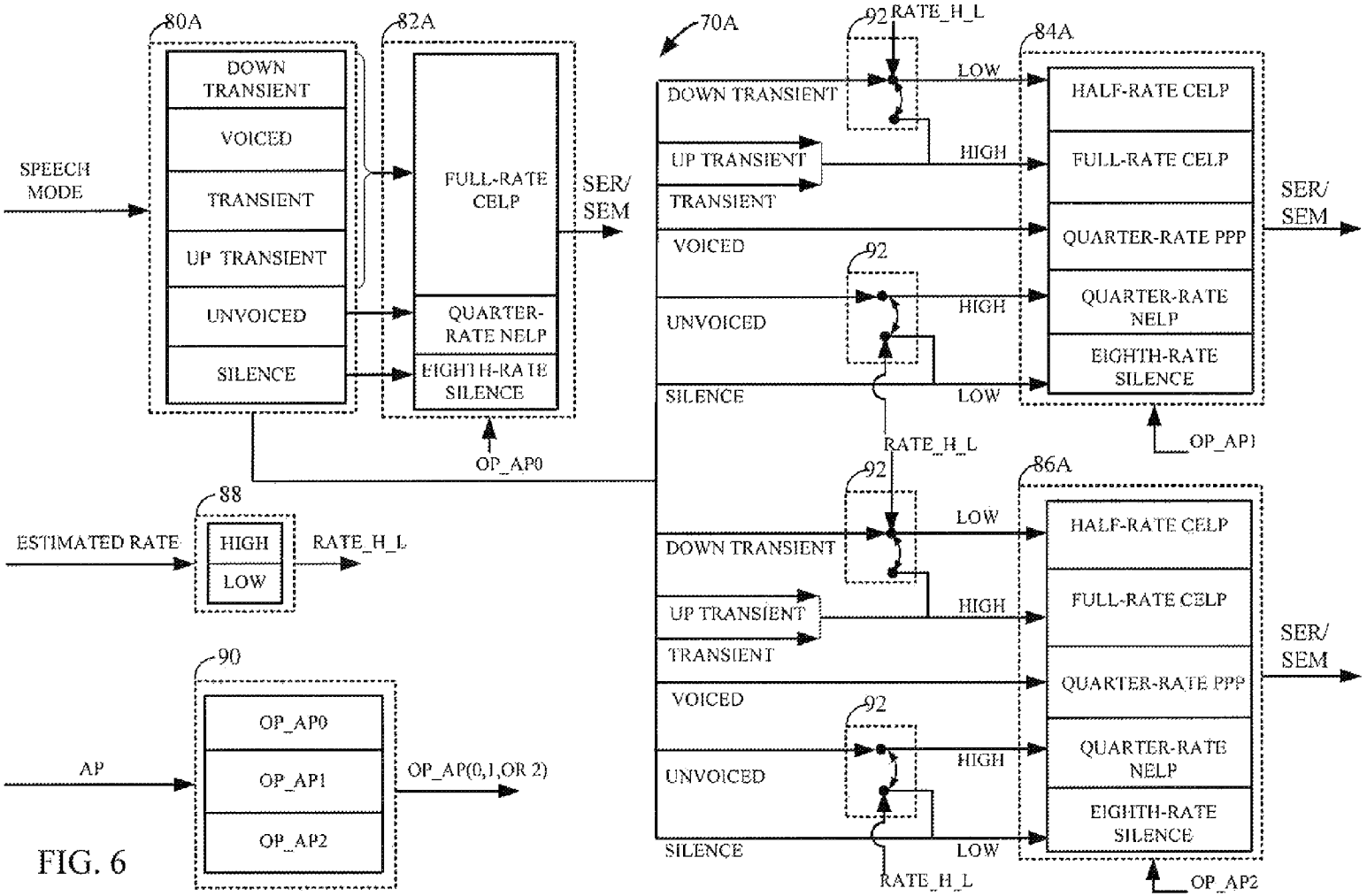

FIG. 6 is an exemplary illustration of a method to map speech mode and estimated rate to a suggested encoding mode (sem) and suggested encoding rate (ser).

Figure 7:
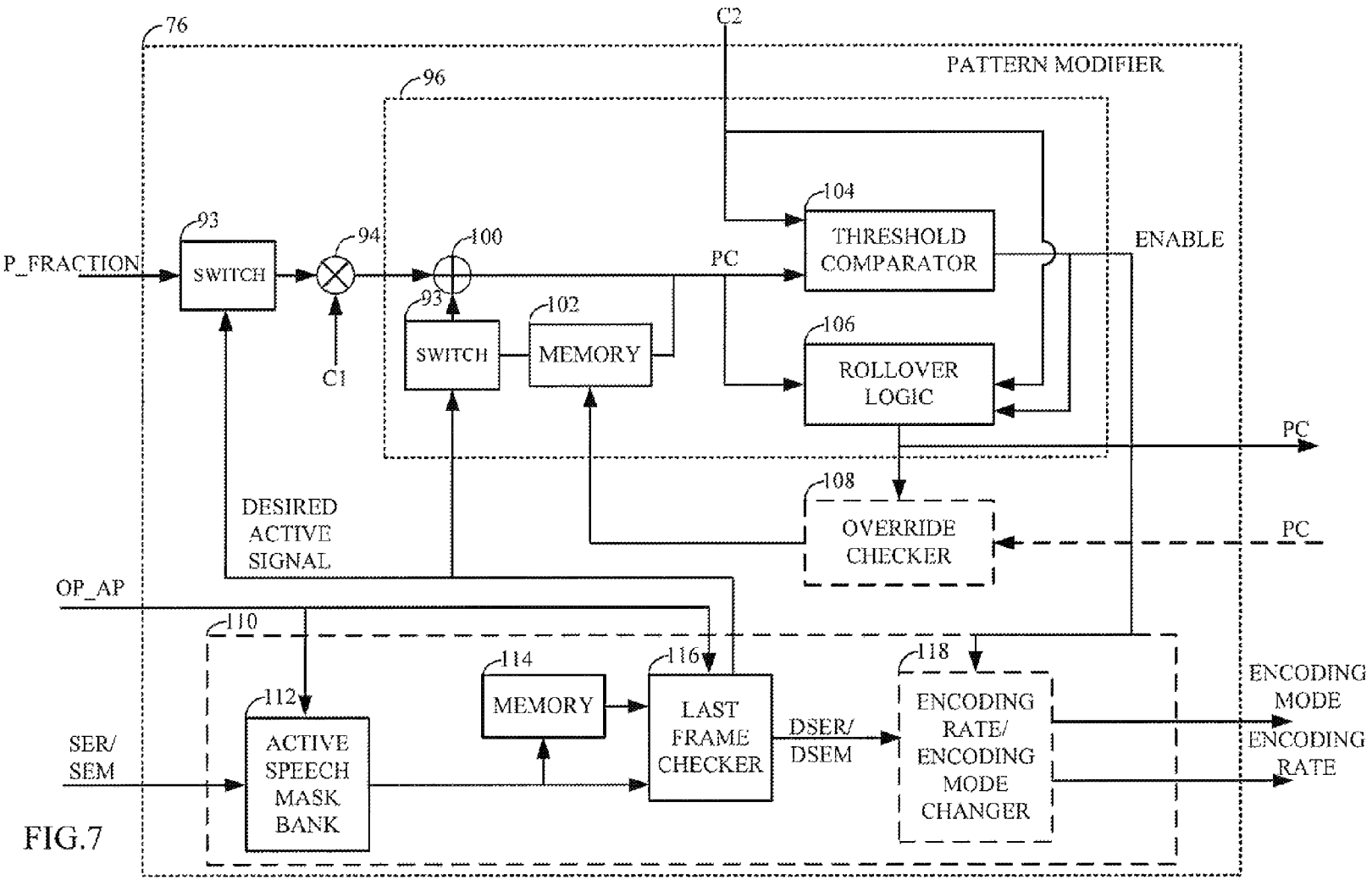

FIG. 7 illustrates a configuration for pattern modifier 76. Pattern modifier 76 outputs a potentially different encoding mode and encoding rate than the sem and ser.

Figure 8:
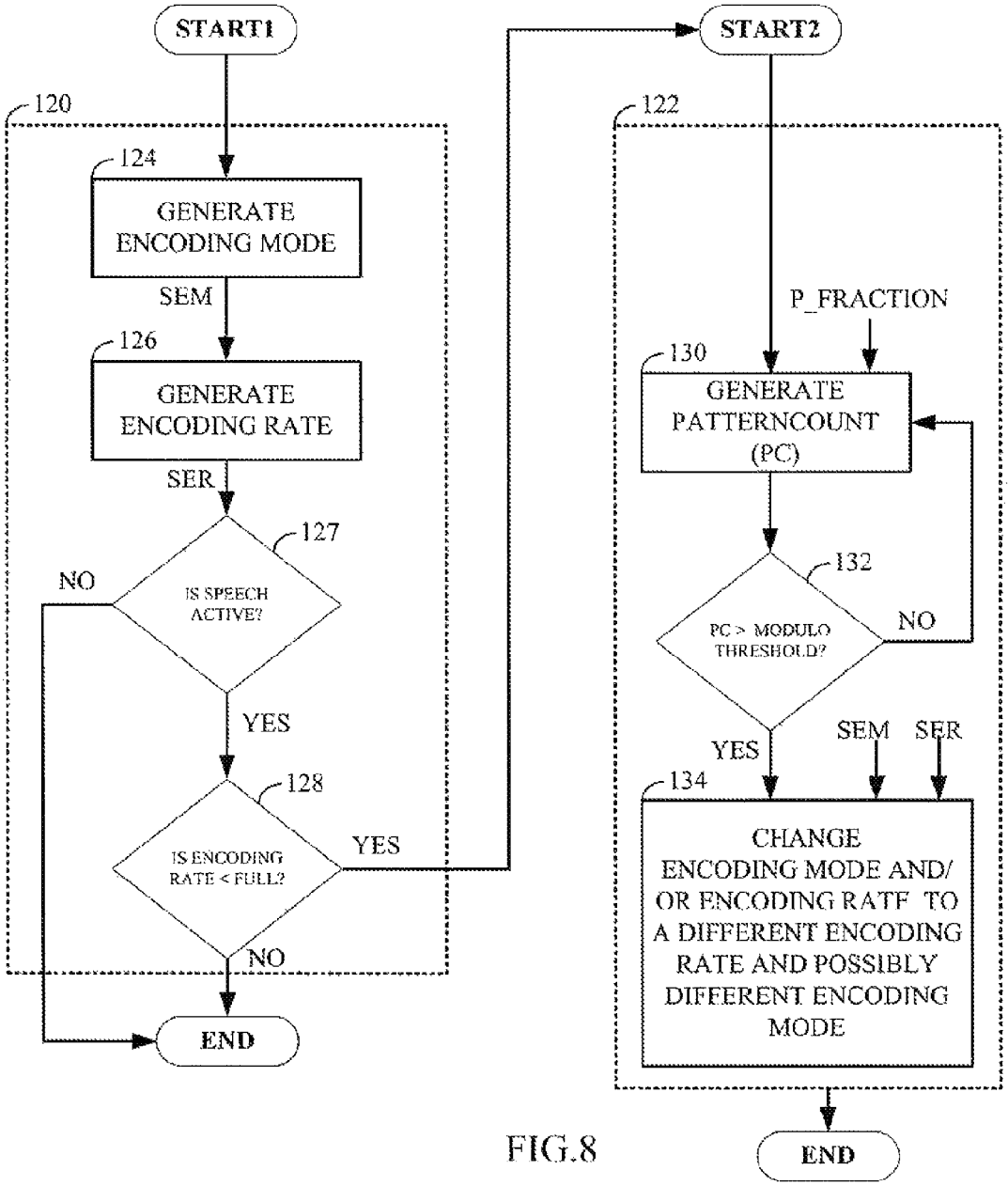

FIG. 8 illustrates a way to change encoding mode and/or encoding rate to a different encoding rate and possibly different encoding mode.

Figure 9:
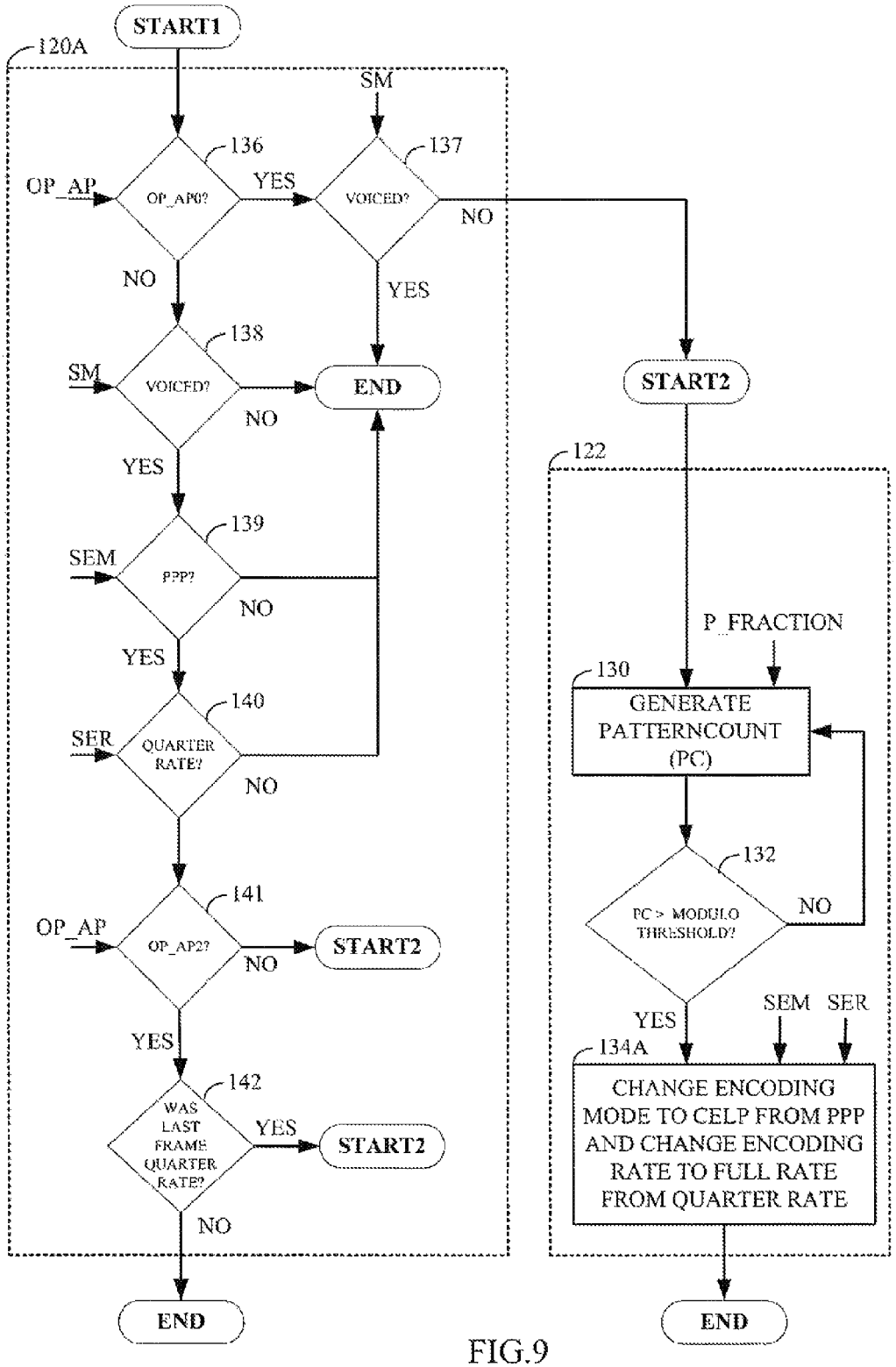

FIG. 9 is another exemplary illustration of a way to change encoding mode and/or encoding rate to a different encoding rate and possibly different encoding mode.

FIG. 10 is an exemplary illustration of pseudocode that may implement a way to change encoding mode and/or encoding rate depending on operating anchor point.

Figure 11:
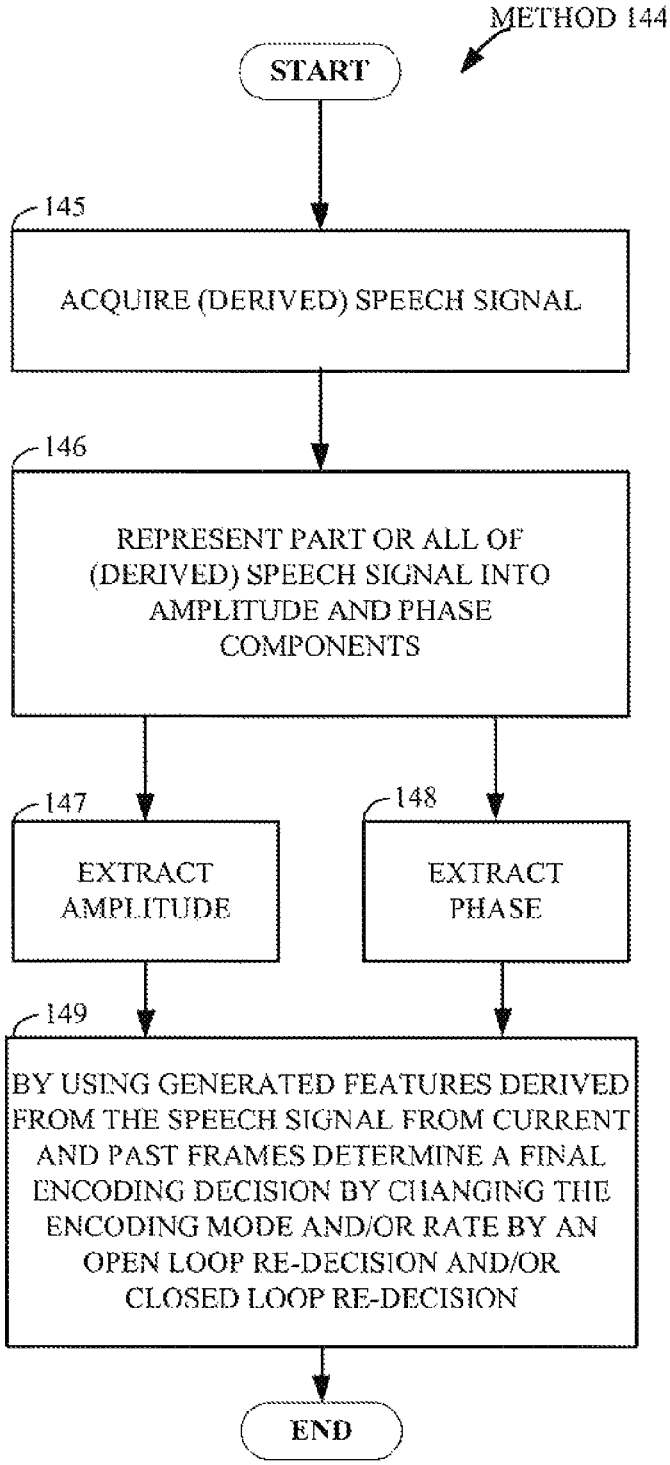

FIG. 11 is an exemplary illustration of a method to determine an encoding decision (either an encoding mode or encoding rate) by an open loop re-decision or a closed loop re-decision.

Figure 12:
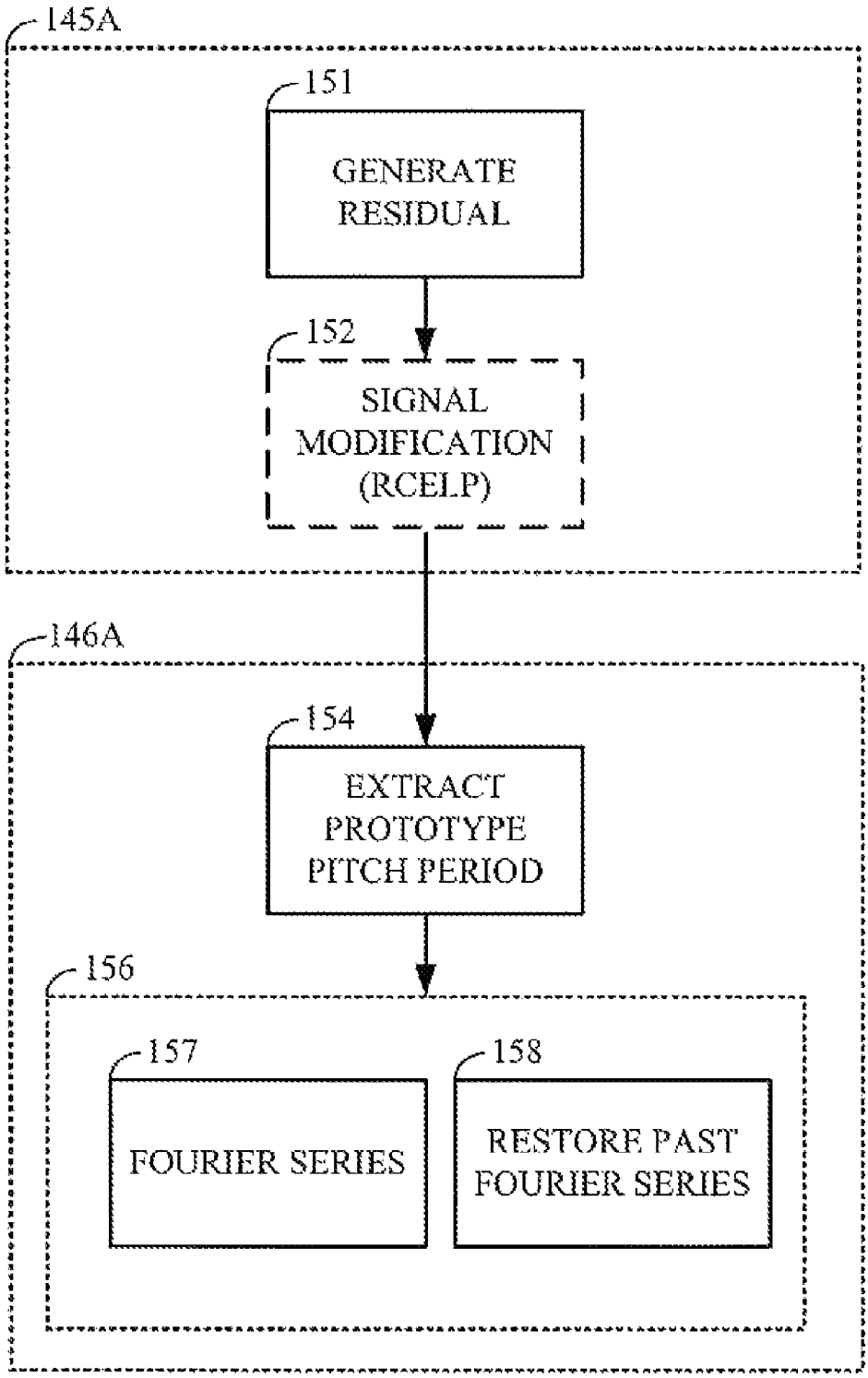

FIG. 12 illustrates exemplary ways to acquire a speech signal or a signal derived from a speech signal and a way to represent the speech signal or derived speech signal by the signal's amplitude and phase components.

Figure 13:
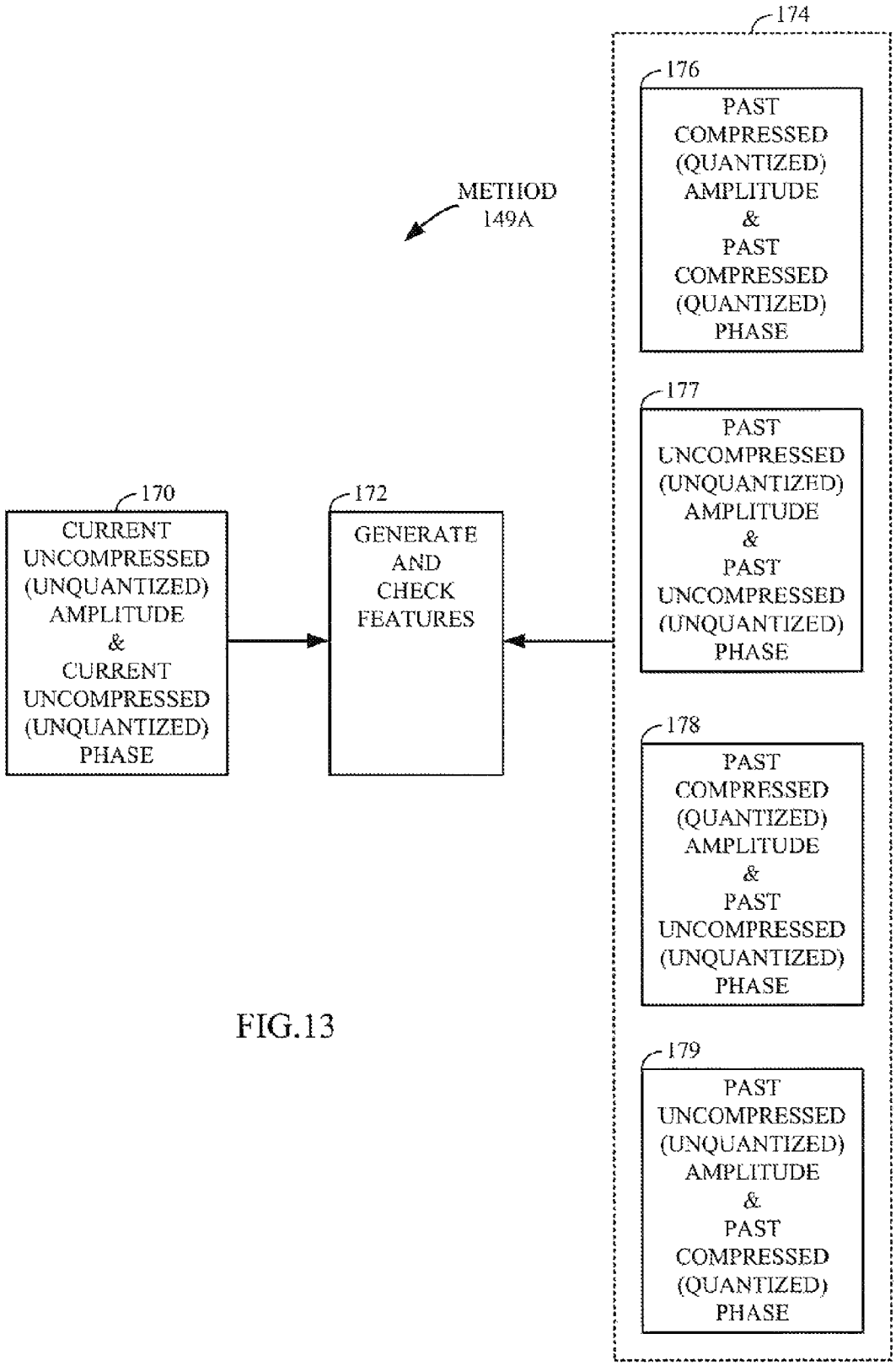

FIG. 13 illustrates a method for computing an open loop re-decision.

Figure 14:
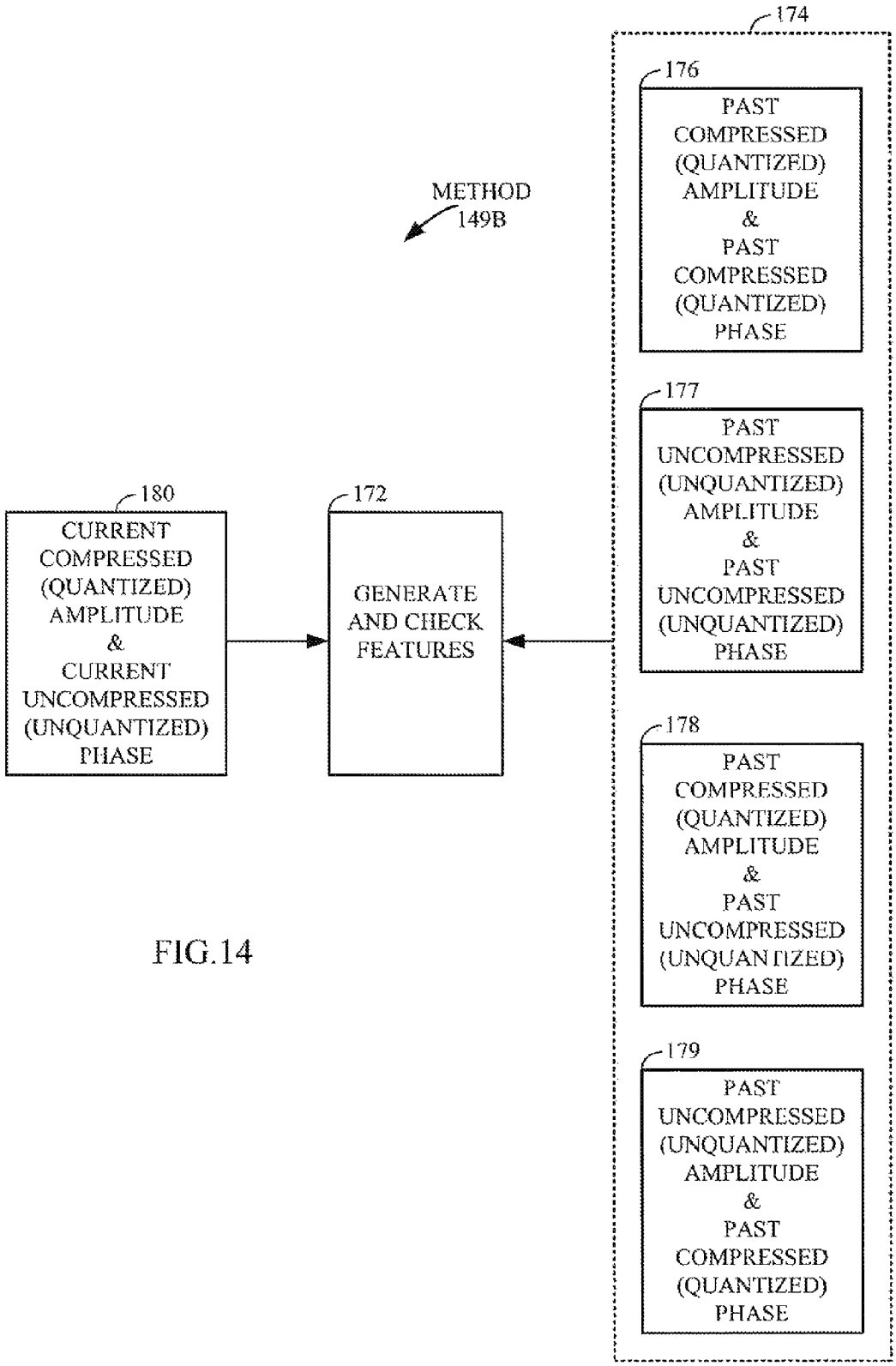

FIG. 14 illustrates a method for computing a closed loop re-decision in a first stage.

Figure 15:
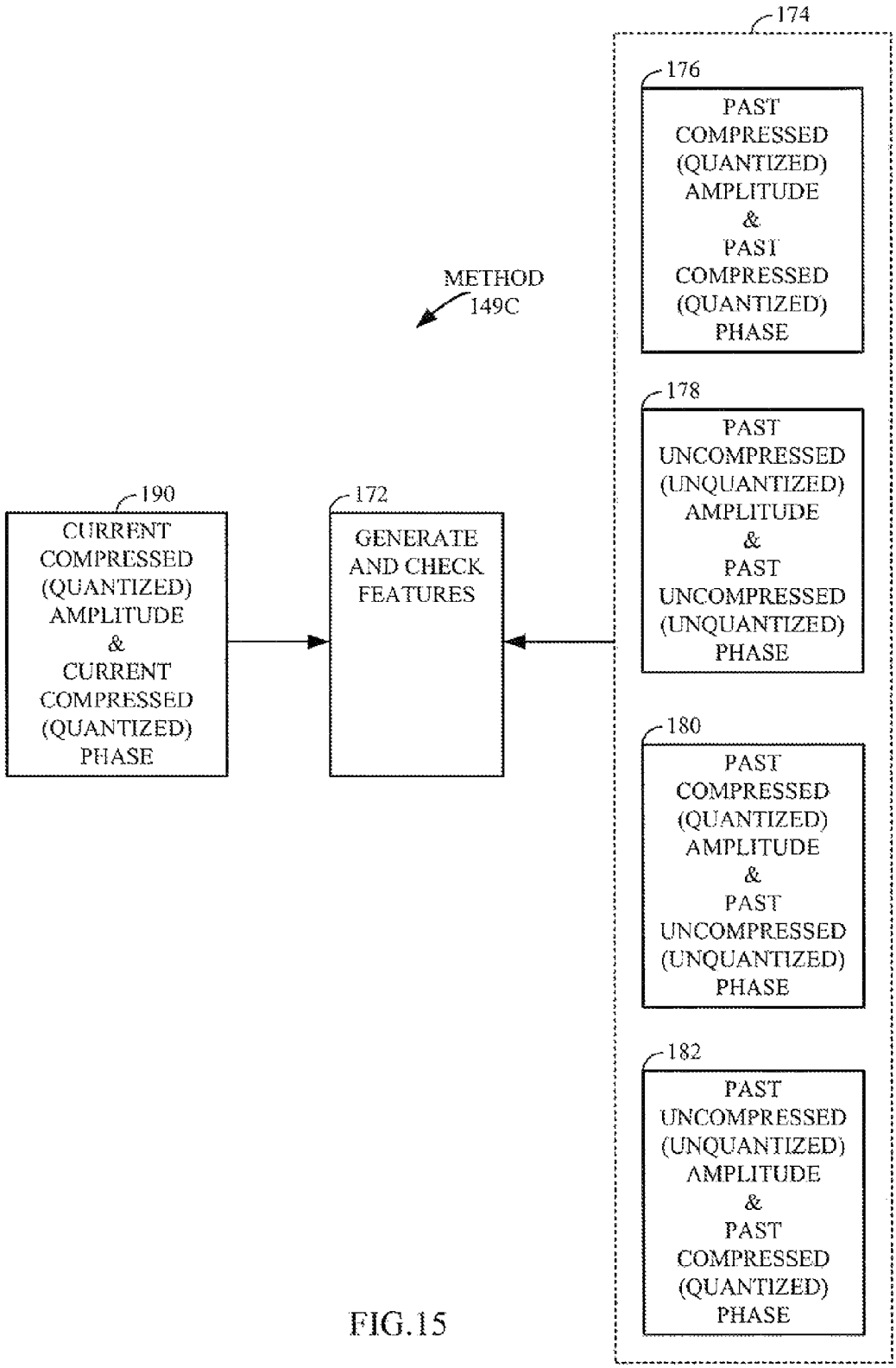

FIG. 15 illustrates a method for computing a closed loop re-decision in a second stage.

Figure 16:
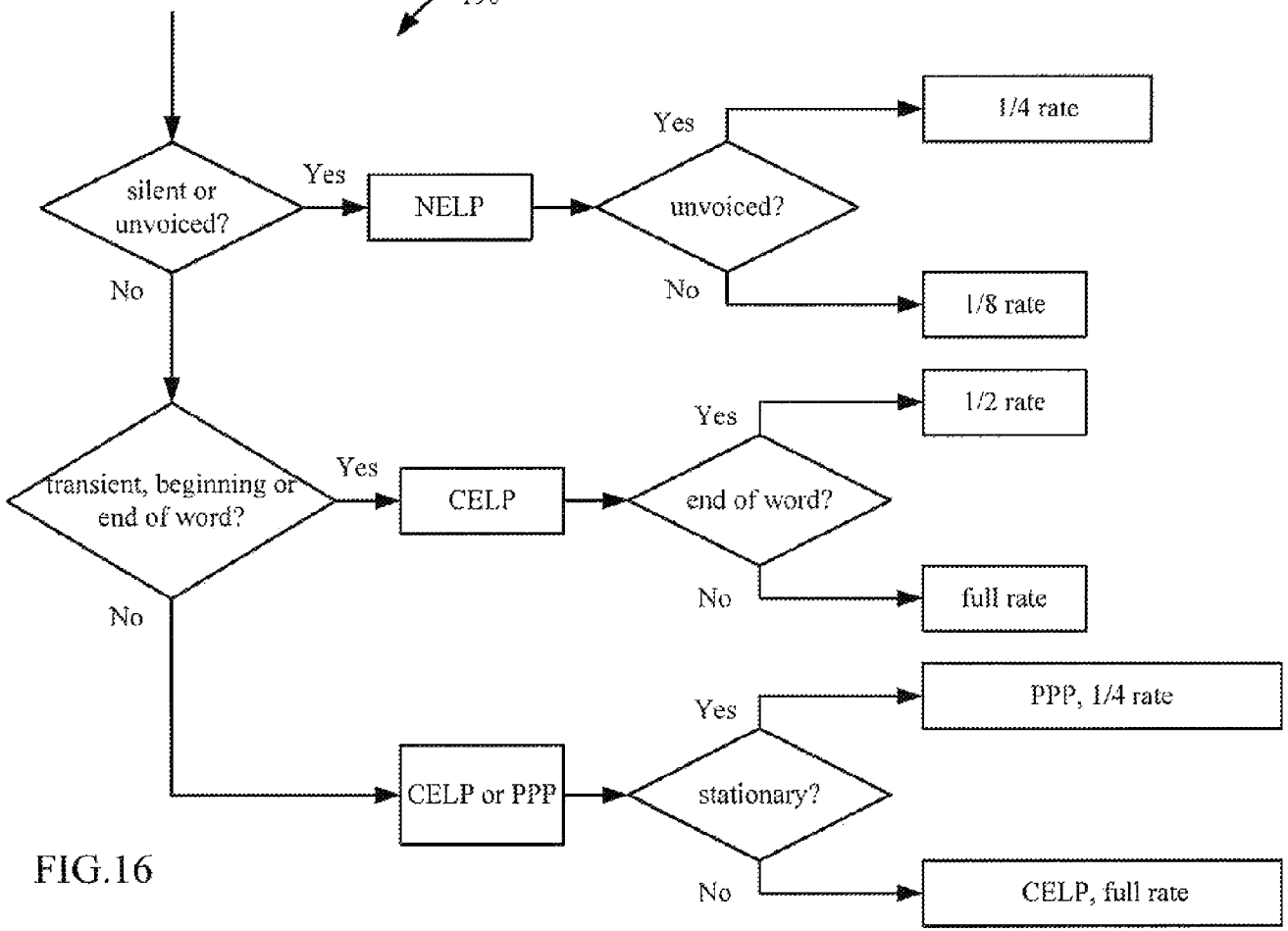

FIG. 16 illustrates an exemplary flowchart for the possible decisions that may be made for encoding mode and/or encoding rate based on aspects described herein.

FIG. 17 is an exemplary illustration of pseudocode that may implement a way to change encoding mode and/or encoding rate depending on operating anchor point or open loop re-decision or closed loop re-decision.

DETAILED DESCRIPTION

Figure 1A:
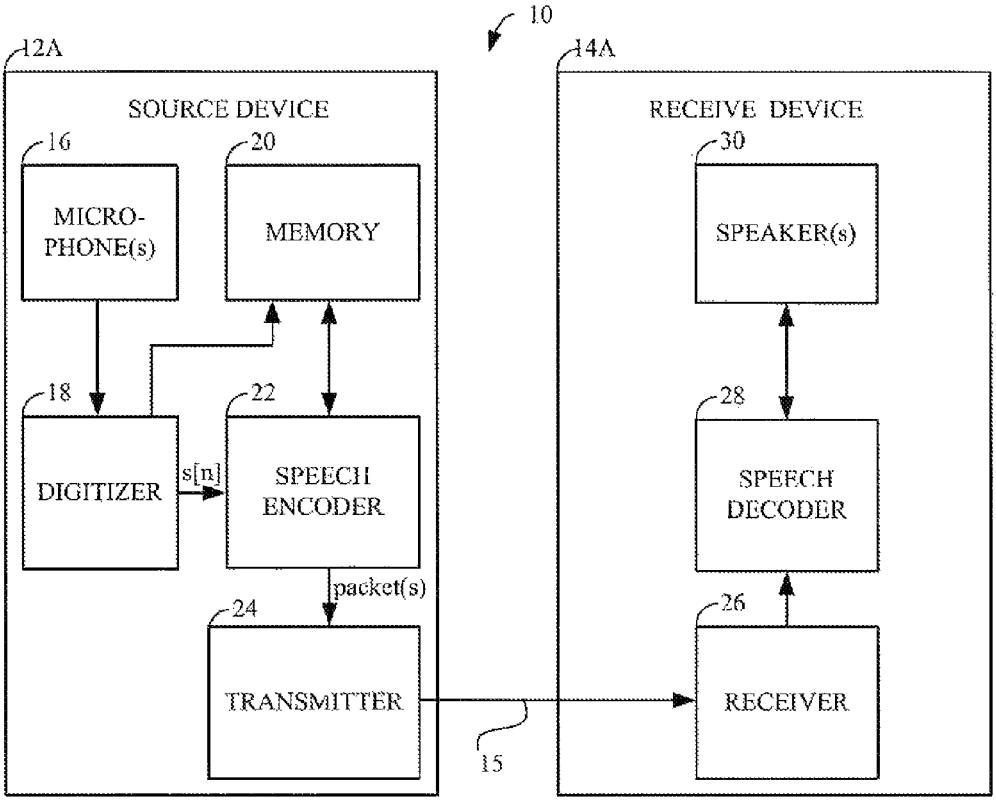
FIG. 1A is a block diagram illustrating an example system in which a source device transmits an encoded bit-stream to a receive device.

FIG. 1A is a block diagram illustrating an example system 10 in which a source device 12*a* transmits an encoded bitstream via communication link 15 to receive device 14*a*. The bitstream may be represented as one or more packets. Source device 12*a* and receive device 14*a* may both be digital devices. In particular, source device 12*a* may encode speech data consistent with the 3GPP2 EVRC-B standard, or similar standards that make use of encoding speech data into packets for speech compression. One or both of devices 12*a*, 14*a* of system 10 may implement selection of encoding modes (based on different coding models) and encoding rates for speech compression, as described in greater detail below, in order to improve the speech encoding process.

Communication link 15 may comprise a wireless link, a physical transmission line, fiber optics, a packet based network such as a local area network, wide-area network, or global network such as the Internet, a public switched telephone network (PSTN), or any other communication link capable of transferring data. The communication link 15 may be coupled to a storage media. Thus, communication link 15 represents any suitable communication medium, or possibly a collection of different networks and links, for transmitting compressed speech data from source device 12*a* to receive device 14*a*.

Source device 12*a* may include one ore more microphones 16 which captures sound. The continuous sound, s(t) is sent to digitizer 18. Digitizer 18 samples s(t) at discrete intervals and quantizes (digitizes) speech, represented by s[n]. The digitized speech, s[n] may be stored in memory 20 and/or sent to speech encoder 22 where the digitized speech samples may be encoded, often over a 20 ms (160 samples) frame. The encoding process performed in speech encoder 22 produces one or more packets, to send to transmitter 24, which may be transmitted over communication link 15 to receive device 14*a*. Speech encoder 22 may include, for example, various hardware, software or firmware, or one or more digital signal processors (DSP) that execute programmable software modules to control the speech encoding techniques, as described herein. Associated memory and logic circuitry may be provided to support the DSP in controlling the speech encoding techniques. As will be described, speech encoder 22 may perform more robustly if encoding modes and rates may be changed prior and/or during encoding at arbitrary target bit rates.

Receive device 14*a* may take the form of any digital audio device capable of receiving and decoding audio data. For example, receive device 14*a* may include a receiver 26 to receive packets from transmitter 24, e.g., via intermediate links, routers, other network equipment, and like. Receive device 14*a* also may include a speech decoder 28 for decoding the one or more packets, and one or more speakers 30 to allow a user to hear the reconstructed speech, s'[n], after decoding of the packets by speech decoder 28.

Figure 1B:
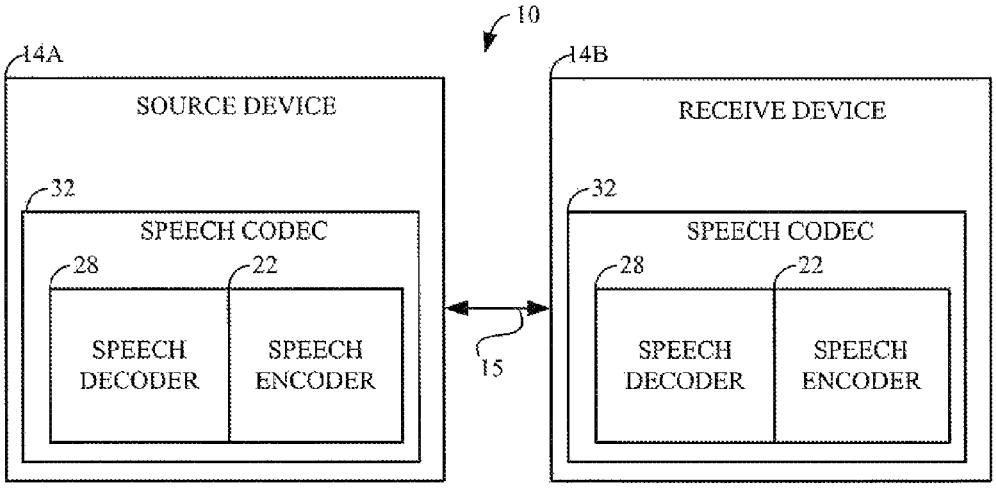
FIG. 1B is a block diagram of two speech codec's that may be used as described in a configuration herein.

In some cases, a source device 12*b* and receive device 14*b* may each include a speech encoder/decoder (codec) 32 as shown in FIG. 1B, for encoding and decoding digital speech data. In particular, both source device 12*b* and receive device 14*b* may include transmitters and receivers as well as memory and speakers. Many of the encoding techniques outlined below are described in the context of a digital audio device that includes an encoder for compressing speech. It is understood, however, that the encoder may form part of a speech codec 32. In that case, the speech codec may be implemented within hardware, software, firmware, a DSP, a microprocessor, a general purpose processor, an application specific integrated circuit (ASIC), a field programmable gate array (FPGA), discrete hardware components, or various combinations thereof.

Figure 2:
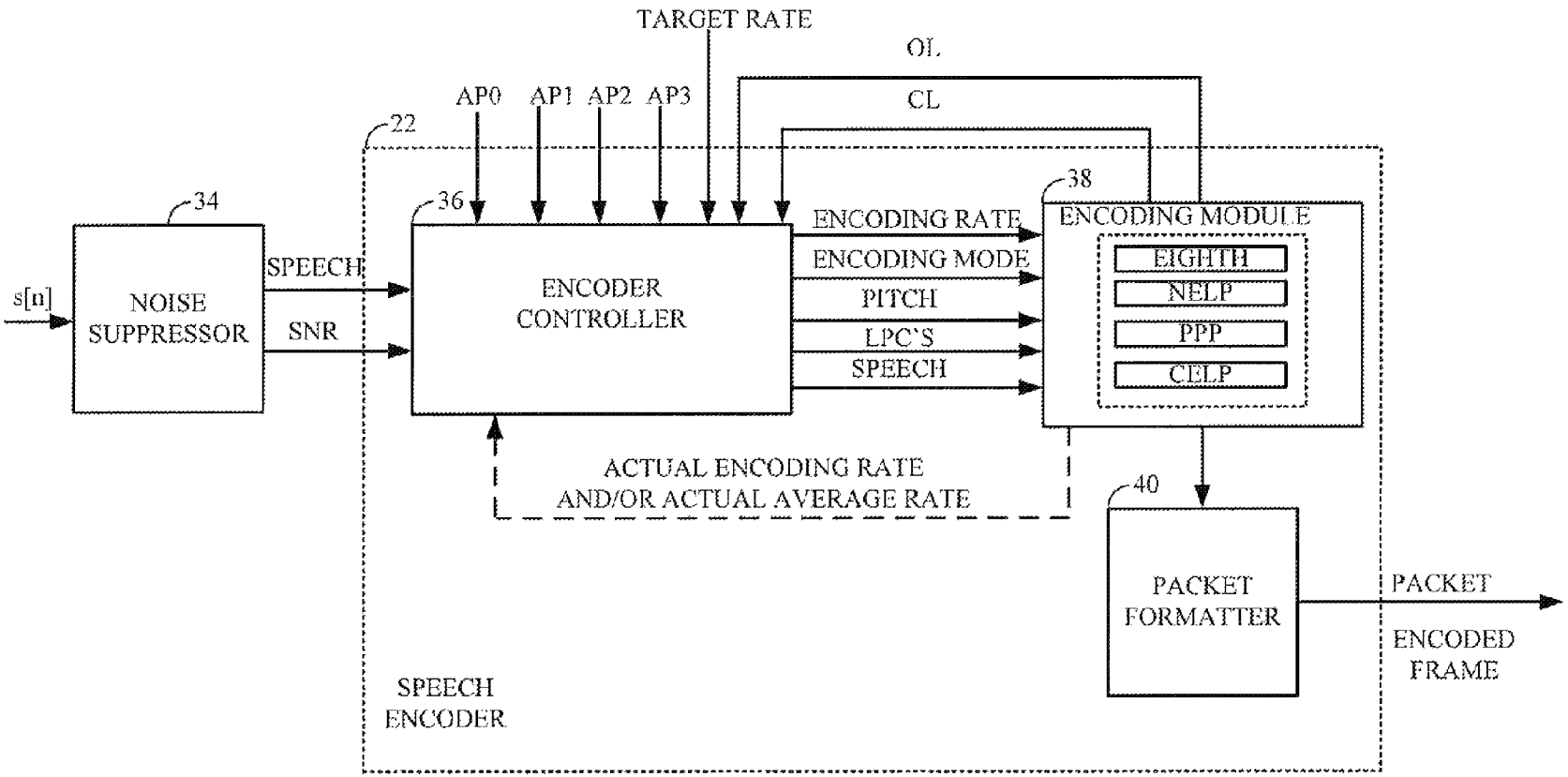
FIG. 2 is an exemplary block diagram of a speech encoder that may be used in a digital device illustrated in FIG. 1A or FIG. 1B.

FIG. 2 illustrates an exemplary speech encoder that may be used in a device of FIG. 1A or FIG. 1B. Digitized speech, s[n] may be sent to a noise suppressor 34 which suppresses background noise. The noise suppressed speech (referred to as speech for convenience) along with signal-to-noise-ratio (snr) information derived from noise suppressor 34 may be sent to speech encoder 22. Speech encoder 22 may comprise a encode controller 36, and encoding module 38 and packet formatter 40. Encoder controller 36 may receive as input fixed target bit rates or target average bit rates, which serve as anchor points, and open-loop (ol) re-decision and closed loop (cl) re-decision parameters. Encoder controller 36 may also receive the actual encoded bit rate,i.e., the bit rate at which the frame was actually encoded. The actual or weighted actual average bit rate may also be received by encoder controller 36 and calculated over a window (ratewin) of pre-determined number of frames, W. As an example, W may be 600 frames. A ratewin window may overlap with a previous ratewin window, such that the actual average bit rate is calculated more often than W frames. This may lead to a weighted actual average bit rate. A ratewin window may also be non-overlapping, such that the actual average bit rate is calculated every W frames. The number of anchor points, may vary. In one aspect, the number of anchor points may be four (ap0, ap1, ap2, and ap3). In one aspect, the ol and cl parameters may be status flags to indicate that prior to encoding or during encoding that an encoding mode and/or encoding rate change may be possible and may improve the perceived quality of the reconstructed speech. In another aspect, encoder controller 36 may ignore the ol and cl parameters. The ol and cl parameters may be used independently or in combination. In one configuration, encoder controller 36 may send encoding rate, encoding mode, speech, pitch information and linear predictive code (lpc) information to encoding module 38. Encoding module 38 may encode speech at different encoding rates, such as eighth rate, quarter rate, half rate and full rate, as well as various encoding modes, such as code excited linear predictive (CELP), noise excited linear predictive (NELP), prototype pitch period (PPP) and/or silence (typically encoded at eighth rate). These encoding modes and encoding rates are decided on a per frame basis. As indicated above, there may be open loop re-decision and closed loop re-decision mechanisms to change the encoding mode and/or encoding rate prior or during the encoding process.

Figure 3:
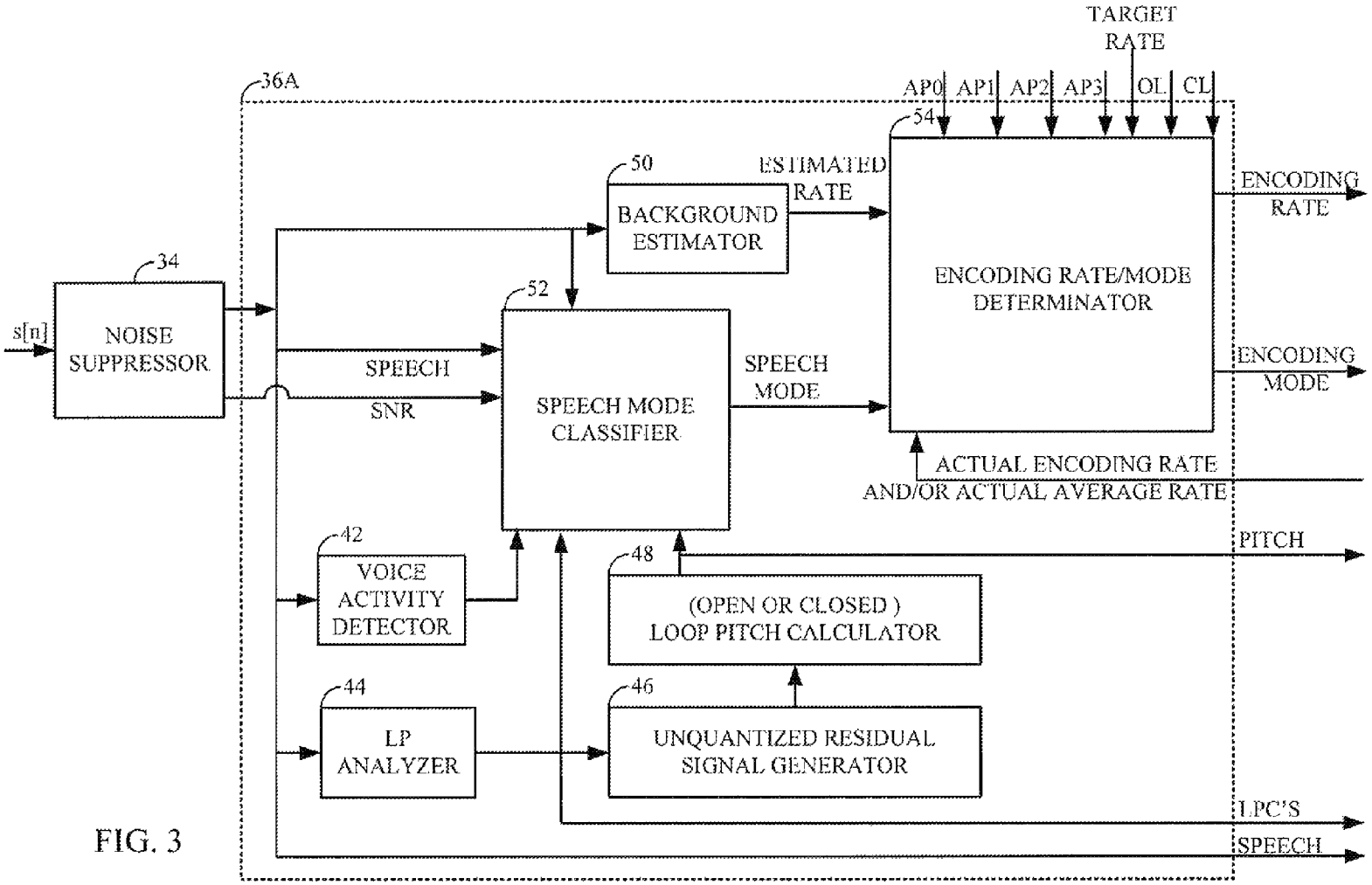
FIG. 3 illustrates details of an exemplary encoding controller 36A.

FIG. 3 illustrates details of an exemplary encoding controller 36A. In one configuration, speech and snr information may be sent to encoding controller 36A. Encoding controller 36A may comprise a voice activity detector 42, lpc analyzer 44, un-quantized residual generator 46, loop pitch calculator 48, background estimator 50, speech mode classifier 52, and encoding mode/rate determinator 54. Voice activity detector (vad) 42 may detect voice activity and in some configurations perform coarse rate estimation. Lp analyzer 44 may generate lp (linear predictive) analysis coefficients which may be used to represent an estimate of the spectrum of the speech over a frame. A speech waveform, such as s[n], may then be passed into a filter that uses the lp coefficients to generate un-quantized residual signal in un-quantized residual signal generator 46. It should be noted that the residual signal is called un-quantized, however, this is to distinguish initial analog-to-digital scalar quantization (the type of quantization that typically happens in digitizer 18) from further quantization. Further quantization is often referred to as compression. The residual signal may then be correlated in loop pitch calculator 48 and an estimate of the pitch frequency (often represented as a pitch lag) is calculated. Background estimator 50 estimates possible encoding rates as eighth-rate, half-rate or full-rate. In some configurations, speech mode classifier 52 may take as inputs pitch lag, vad decision, lpc's, speech, and snr to compute a speech mode. In other configurations, speech mode classifier 52 may have a background estimator 50 as part of it's functionality to help estimate encoding rates in combination with speech mode. Whether speech mode and estimated encoding rate are output by background estimator 50 and speech mode classifier 52 separately (as shown) or speech mode classifier 52 outputs both speech mode and estimated encoding rate (in some configurations), encoding rate/mode determinator 54 may take as inputs an estimated rate and speech mode and may output encoding rate and encoding mode as part of it's output. Those of ordinary skill in the art will recognize that there are a wide array of ways to estimate rate and classify speech. Encoding rate/mode determinator 54 may receive as input fixed target bit rates, which may serve as anchor points. For example, there may be four anchor points, ap0, ap1, ap2 and ap3, and/or open-loop (ol) re-decision and closed loop (cl) re-decision parameters. As mentioned previously, in one aspect, the ol and cl parameters may be status flags to indicate prior to encoding or during encoding that an encoding mode and/or encoding rate change may be required. In another aspect, encoding rate/mode determinator 54 may ignore the ol and cl parameters. In some configurations, ol and cl parameters may be optional. In general, the ol and cl parameters may be used independently or in combination.

An exemplary encoding rate/mode determinator 54A is illustrated in FIG. 4. Encoding rate/mode determinator 54A may comprise a mapper 70 and dynamic encoding mode/rate determinator 72. Mapper 70 may be used for mapping speech mode and estimated rate to a "suggested" encoding mode (sem) and "suggested" encoding rate (ser). The term "suggested" means that the actual encoding mode and actual encoding rate may be different than the sem and/or ser. For exemplary purposes, dynamic encoding mode/rate determinator 72 may change the suggested encoding rate (ser) and/or the suggested encoding mode (sem) to a different encoding mode and/or encoding rate. Dynamic encoding mode/rate determinator 72 may comprise a capacity operating point tuner 74, a pattern modifier 76 and optionally an encoding rate/mode overrider 78. Capacity operating point tuner 74 may use one or more input anchor points, the actual average rate, and a target rate (that may be the same or different from the input anchor points) to determine a set of operating anchor points. It should be noted that sometimes that operating anchor points may be referred interchangeably with anchor operating points. Throughout the remainder of this disclosure operating anchor points terminology will be used. If non-overlapping ratewin windows are used, M may be equal to W. As such, in an exemplary configuration, M may be around 600 frames. It is desired that M be large enough to prevent duration of unvoiced speech, such as drawn out "s" sounds from distorting the average bit rate calculation. Capacity operating point tuner 74 may generate a fraction (p_fraction) of frames to potentially change the suggested encoding mode (sem)/and or suggested encoding rate (ser) to a different sem and/or ser.

Pattern modifier 76 outputs a potentially different encoding mode and encoding rate than the sem and ser. In configurations where encoding rate/mode overrider 78 is used, ol re-decision and cl re-decision parameters may be used. Decisions made by encoding controller 36A through the operations completing pattern modifier 76, may be called "open-loop" decisions, i.e., the encoding mode and encoding rate output by pattern modifier 76 (prior to any open or closed loop re-decision (see below)) may be an open loop decision. Open loop decisions performed prior to compression of at least one of either amplitude components or phase components in a current frame and performed after pattern modifier 76 may be considered open-loop (ol) re-decisions. Re-decision are named as such because a re-decision (open loop and/or closed loop) has determined if encoding mode and/or encoding rate may be changed to a different encoding mode and/or encoding rate. These re-decisions may be one or more parameters indicating that there was a re-decision to change the sem and/or ser to a different encoding mode or encoding rate. If encoding mode/rate overrider 78 receives an ol re-decision the encoding mode and/or encoding rate may be changed to a different encoding mode and/or encoding rate. If a re-decision (ol or cl) occurs the patterncount (see FIG. 4) may be sent back to pattern modifider 76 and via override checker 108 (see FIG. 7) the patterncount may be updated. Closed loop (cl) re-decisions may be performed after compression of at least one of either amplitude components or phase components in a current frame may involve some comparison involving variants of the speech signal. There may be other configurations, where encoding rate/mode overrider 78 is located as part of encoding module 38. In such configurations, there may not need to be any repeating of any prior encoding process, a switch in the encoding process is made to accommodate for the re-decision to change encoding mode and/or encoding rate. A patterncount (see FIG. 7) may still be kept and sent to pattern modifider 76 and override checker 108 (see FIG. 7) may then aid in updating the value of patterncount to reflect the re-decision.

FIG. 5 is an illustration of a method to map speech mode and estimated rate to a suggested encoding mode (sem) and suggested encoding rate (ser). Routing of speech mode to a desired encoding mode/rate map 80 may be carried out. Depending on operating anchor point (op_ap0, op_ap1, or op_ap2) there may be a mapping of speech mode and estimated rate (via rate_h_1, see below) to encoding mode and encoding rate 82 84 86. The estimated rate may be converted from a set of three values (eighth-rate, half-rate, and full-rate) to a set of two values, low-rate or high-rate 88. Low-rate may be eighth-rate and high-rate may be not eighth-rate (e.g. either half-rate or full-rate is high-rate). Low-rate or high-rate is represented as rate_h_1. Routing of op_ap0, op_ap1 and op_ap2 to desired encoding rate/encoding mode map 90 selects which map may be used to generate a suggested encoding mode (sem) and/or suggested encoding rate (ser).

FIG. 6 is an exemplary illustration of a method to map speech mode and estimated rate to a suggested encoding mode (sem) and suggested encoding rate (ser). Exemplary speech modes may be down transient, voiced, transient, up transient, unvoiced and silence. Depending on operating anchor point, the speech modes may be routed 80A and mapped to various encoding rates and encoding modes. In this exemplary illustration, exemplary operating anchor points op ap0, op ap1, and op ap2 may loosely be operating over "high" bit rate (op_ap0), "medium" bit rate (op_ap1), and "low" bit rate (op_ap2). High, medium, and low bit rates, as well as specific numbers for the anchor points may vary depending on the capacity of the network (e.g. WCDMA) at different times of the day and/or region. For operating anchor point zero, op_ap0, an exemplary mapping 82A is shown as follows: speech mode silence may be mapped to eighth-rate silence; speech mode unvoiced may be mapped to quarter-rate NELP; all other speech modes may be mapped to full-rate CELP. For operating anchor point one, op_ap1, an exemplary mapping 84A is shown as follows: speech mode silence may be mapped to eighth-rate silence; speech mode unvoiced may be mapped to quarter-rate nelp if rate_h_1 92 is high, and may be mapped to eighth-rate silence if rate_h_1 92 is low; speech mode voiced may be mapped to quarter-rate PPP (or in other configurations half-rate, or full rate); speech modes up transient and transient may be mapped to full-rate CELP; speech mode down transient may be mapped to full-rate CELP if rate_h_1 92 is high and may be mapped to half-rate CELP if rate_h_1 92 is low. For operating anchor point two, op_ap2, the exemplary mapping 86A may be as was described for op_ap1. However, because op_ap2 may be operating over lower bit rates, the likelihood that speech mode voiced may be mapped to half-rate or full-rate is small.

FIG. 7 illustrates a configuration for pattern modifier 76. Pattern modifier 76 outputs a potentially different encoding mode and encoding rate than the sem and ser. Depending on the fraction (p_fraction) of frames received as an input, this may be done in a number of ways. One way is to use a lookup table (or multiple tables if desired) or any equivalent means, and a priori determine (i.e., pre-determine) how many frames, K, may change out of F frames, for example, from half rate to full rate, irrespective of encoding mode when a certain fraction is received. In one aspect, the fraction may be used exactly, for example, ⅓, may mean change every $3^{rd}$ frame. In another aspect, the fraction may also mean round to the nearest integer frame before changing the encoding rate. For example, 0.36, may be rounded to the nearest integer numerator out of 100. This may mean that every $36^{th}$ frame out of 100 frames a change in encoding rate may be made. If the fraction were 0.360 it may mean that every $360^{th}$ frame out of 1000 frame may be changed. Even if the fraction were carried out to more places to the right of the decimal, truncation to less places to the right of the decimal may change in which frame the encoding rate may be changed. In another aspect, fractions may be mapped to a set of fractions. For example, 0.36 may be mapped to ⅜ (every K=3 out of F=8 frames a change in encoding rate may be made), and 0.26 may get mapped to ⅕ (every K=1 out of F=5 frames a change in encoding rate may be made). Another way is to use a different lookup table(s) or equivalent means and in addition to pre-determining in how many frames K out of F (e.g., 1 out of 5, or 3 out of 8) may change from one encoding rate to another, other logic may take into account the encoding mode as well. Yet another way that pattern modifier 76 may output a potentially different encoding mode and encoding rate than the sem and ser is to dynamically (not pre-determined) determine in which frame the encoding rate and/or encoding mode may change.

There are a number of dynamic ways that pattern modifier 76 may determine in which frame the encoding rate and/or encoding mode may change. One way is to combine a pre-determined way, for example, one of the ways described above will be illustrated, with a configurable modulo counter. Consider the example of 0.36 being mapped to the pre-determined fraction ⅜. The fraction ⅜ may indicate that a pattern of changing the encoding rate three out of eight frames may be repeated a number of pre-determined times. For example, in a series of eighty frames, for example, there may be a pre-determined decision to repeat the pattern ten times, i.e., out of eighty frames, the encoding rate of thirty of the eighty frames were potentially changed to a different rate. There may be logic to pre-determine in which 3 out of 8 frames the encoding rate be changed. Thus, the number of which thirty frames out of eighty (in this example) is pre-determined. However, there may be a finer resolution, more flexible control and robust way to determine in which frame the encoding rate may change by converting a fraction into an integer and counting the integer with a modulo counter. Since the ratio ⅜ equals the fraction 0.375, the fraction may be scaled to be an integer, for example, 0.375*1000=375. The fraction may also be truncated and then scaled, for example, 0.37*100=37, or 0.3*10=30. In the preceding examples, the fraction was converted into integers, either 375, 37 or 30. As an example, consider using the integer that was derived by using the highest resolution fraction, namely, 0.375 in equation (1). Alternatively, the original fraction, 0.360, could be used as the highest resolution fraction to convert into an integer and used in equation (1). For every active speech frame and desired encoding mode and/or desired encoding rate the integer in equation (1) may be added by a modulo operation as shown by equation (1) below:

$$\text{patterncount}=\text{patterncount}+\text{integer mod modulo_threshold} \qquad \text{equation (1)}$$

where, patterncount may initially be equal to zero and modulo_threshold may be the scaling factor used to scale the fraction.

A generalized form of equation (1) is shown by equation (2). By implementing equation (2) a more flexible control in the number of possible ways to dynamically determine in which frame the encoding rate and/or encoding mode may change may be obtained.

$$\text{patterncount}=(\text{patterncount}+c1*\text{fraction})\bmod c2 \qquad \text{equation (2)}$$

where, c1 may be the scaling factor, fraction may be the p_fraction received by pattern modifier 76 or a fraction may be derived (for example, by truncating p_fraction or some form of rounding of p_fraction) from p_fraction, and c2 may be equal to c1, or may be different than c1.

Pattern modifier 76 may comprise a switch 93 to control when multiplication with multiplier 94 and modulo addition with adder modulo adder 96 occurs. When switch 93 is activated via desired active signal multiplier 94 multiplies p_fraction (or a variant) by a constant c1 to yield an integer. Modulo adder 96 may add the integer for every active speech frame and desired encoding mode and/or desired encoding rate. The constant c1 may be related to the target rate. For example, if the target rate is on the order of kilo-bits-per-second (kbps), c1 may have the value 1000 (representing 1 kbps). To preserve the number of frames changed by the resolution of p_fraction, c2 may be set to c1. There may be a wide variety of configurations for modulo c2 adder 96, one configuration is illustrated in FIG. 7. As explained above, the product c1*p_fraction may be added via adder 100, to a previous value fetched from memory 102, patterncount (pc). Patterncount may initially be any value less than c2, although zero is often used. Patterncount (pc) may be compared to a threshold c2 via threshold comparator 104. If pc exceeds the value of c2, then an enable signal is activated. Rollover logic 106 may subtract off c2 from pc and modify the pc value when the enable signal is activated, i.e., if pc>c2 then rollover logic 106 may implement the following subtraction: pc=pc−c2. The new value of pc, whether updated via adder 100 or updated after rollover logic106 may then be stored back in memory 102. In some configurations, override checker 108 may also subtract off c2 from pc. Override checker may be optional but may be required when encoding rate/mode overrider 78 is used or overrider 78 is present with dynamic encoding rate/mode determinator 72.

Encoding mode/encoding rate selector 110 may be used to select an encoding mode and encoding rate from an sem and ser. In one configuration, active speech mask bank 112 acts to only let active speech suggested encoding modes and encoding rates through. Memory 114 is used to store current and past sem's and ser's so that last frame checker 116 may retrieve a past sem and past ser and compare it to a current sem and ser. For example, in one aspect, for operating point anchor point two (op_ap2) the last frame checker 116 may determine that the last sem was ppp and the last ser was quarter rate. Thus, the signal sent to encoding rate/encoding mode changer may send a desired suggested encoding mode (dsem) and desired suggested encoding rate (dser) to be changed by encoding rate/mode overrider 78. In other configurations, for example, for operating anchor point zero a dsem and dser may be unvoiced and quarter-rate, respectively. A person or ordinary skill in the art will recognize that there may multiple ways to implement the functionality of encoding mode/encoding rate selector 110, and further recognize that the terminology desired suggested encoding mode and desired suggested encoding rate is used here for convenience. The dsem is an sem and the ser is an ser, however, the which sem and ser to change may depend on a particular configuration, for example, which depends in whole or in part on operating anchor point.

An example may better illustrate the operation of pattern modifier 76. Consider the case for operating anchor point zero (op_ap0) and the following pattern of 20 frames (7u, 3v, 1u, 6v, 3u) uuuuuuuvvvuvvvvvvuuu, where u=unvoiced and v=voiced. Suppose that patterncount (pc) has a value of 0 at the beginning of the 20 frame pattern above, and further suppose that p_fraction is ⅓ and c1 is 1000 and c2 is 1000. The decision to change unvoiced frames to, for example, from quarter rate nelp to full-rate celp during operating anchor point zero would be as follows in Table 1.

TABLE 1

| frame | patterncount (pc) | Equation (1) and rollover logic used to calculate next pc value: if pc > c2, then pc = pc − c2 | encoding rate | encoding mode | speech |
|---|---|---|---|---|---|
| 1 | 333 | 0 + ⅓ * 1000 | quarter-rate | nelp | u |
| 2 | 666 | 333 + 333 | quarter-rate | nelp | u |
| 3 | 999 | 666 + 333 | quarter-rate | nelp | u |
| 4 | 1332 | If 1332 > 1000, 1332 − 1000 = 332 Now apply eq. 1: 332 + 333 | full-rate | celp | u |
| 5 | 665 | 665 + 333 | quarter-rate | nelp | u |
| 6 | 998 | 998 + 333 | quarter-rate | nelp | u |
| 7 | 1031 | If 1031 > 1000, 1031 − 1000 = 31 Now apply eq. 1: 31 + 333 | full-rate | celp | u |
| 8-10 | 364 | In op_ap0, may only update pc for unvoiced speech mode | x | y | v |
| 11 | 364 | 364 + 333 | quarter-rate | nelp | u |
| 12-17 | 697 | In op_ap0, may only update pc for unvoiced speech | x | y | v |
| 18 | 697 | 697 + 333 | quarter-rate | nelp | u |
| 19 | 1000 | 1000 + 333 | quarter-rate | nelp | u |
| 20 | 1333 | If 1333 > 1000, 1333 − 1000 = 333 Now apply eq. 1: 333 + 333 | full-rate | celp | u |

Note that the $4^{th}$ frame, the $7^{th}$ frame and the $20^{th}$ frame all changed from quarter-rate nelp to full-rate celp, although the sem was nelp and ser was quarter-rate. In one exemplary aspect, for operating point anchor point zero (op_ap0), patterncount may only be updated for unvoiced speech mode when sem is nelp and ser is quarter rate. During other conditions, for example, speech being voiced, the sem and ser may not be considered to be changed, as indicated by the x and y in the penultimate column of Table 1.

To further illustrate the operation of modifier 76, consider a different case, for operating anchor point one (op_ap1), when there is the following pattern of 20 frames (18v, 1u, 1v) vvvvvvvuuuvvvvvvuuuv, where u=unvoiced and v=voiced. Suppose that patterncount (pc) has a value of 0 at the beginning of the 20 frame pattern above, and further suppose that p_fraction is ⅕ and c1 is 1000 and c2 is 1000. As en example, let the encoding mode or the 20 frames be (ppp, ppp, ppp, celp, celp, celp, celp, ppp, nelp, nelp, nelp, nelp, ppp, ppp, ppp, ppp, ppp, celp, celp, ppp) and the encoding rate be one amongst eighth rate, quarter rate, half rate and full rate. The decision to change voiced frames that have an encoding rate of a quarter rate and an encoding mode of ppp, for example, from quarter rate ppp to full-rate celp during operating anchor point one (op_ap0) would be as follows in Table 2.

TABLE 2

| frame | patterncount (pc) | equation (1) and rollover logic used to calculate next pc value: if pc > c2, then pc = pc − c2 | encoding rate | encoding mode | sem |
|---|---|---|---|---|---|
| 1 | 250 | 0 ¼ * 1000 | quarter-rate | pppp | ppp |
| 2 | 500 | 250 + 250 | quarter-rate | pppp | ppp |
| 3 | 750 | 500 + 250 | quarter-rate | ppp | ppp |
| 4-7 | 750 | In op_ap1, may only update pc for voiced quarter-rate ppp | x | y | celp |
| 8 | 750 | In op_ap1, may only update pc for voiced quarter-rate ppp | full-rate | ppp | ppp |
| 9-12 | 750 | In op_ap1, may only update pc for voiced quarter-rate ppp | x | nelp | nelp |
| 13 | 1000 | 750 + 250 | quarter-rate | ppp | ppp |
| 14 | 1000 | In op_ap1, may only update pc for voiced quarter-rate ppp | full-rate | celp | ppp |
| 15 | 1250 | If 1250 > 1000, 1250 − 1000 = 250 Now apply eq. 1: 250 + 250 | full-rate | celp | ppp |
| 16 | 500 | In op_ap1, may only update pc for voiced quarter-rate ppp | full-rate | ppp | ppp |
| 17 | 750 | 500 + 250 | quarter-rate | ppp | ppp |
| 18-19 | 1250 | In op_ap1, may only update pc for voiced quarter-rate ppp | full-rate | celp | celp |
| 20 | 1000 | 750 + 250 | quarter-rate | ppp | ppp |

FIG. 8 illustrates a way to change encoding mode and/or encoding rate to a different encoding rate and possibly different encoding mode. Method 120 comprises generating an encoding mode (such as an sem) 124, generating an encoding rate (such as an ser) 126, checking if there is active speech 127, and checking if the encoding rate is less than full 128. In one aspect, if these conditions are met, method 122 decides to change encoding mode and/or encoding rate. After using a fraction of frames to potentially change the encoding mode and/or encoding rate, a patterncount (pc) is generated 130 and checked against a modulo threshold 132. If the pc is less than the modulo threshold the pc is modulo added to an integer scaled version of p_fraction to yield a new pc 130 and for every active speech frame. If the pc is greater than the modulo threshold, a change of encoding mode and/or encoding rate to a different encoding rate and possibly different encoding mode. A person of ordinary skill in the art, will recognize that other variations of method 120 may allow encoding rate equal to full before proceeding to method 122.

FIG. 9 is another exemplary illustration of a way to change encoding mode and/or encoding rate to a different encoding rate and possibly different encoding mode. An exemplary method 120A may determine which sem and ser for different operating anchor points may be used with method 122. In exemplary method 120A, when decision block 136 checking for operating anchor point zero (op_ap0) and decision block 137 checking for not-voiced speech are yes, this may yield unvoiced speech mode (and unspecified sem and ser) (see FIG. 5 for a possible choice) may be used with method 122. Decision blocks 138-141 checking for voiced, sem of pp, ser of quarter-rate, and operating anchor point of 2, yielding yes, yes, yes, and no, respectively, may yield that an sem of pp and ser of quarter-rate for operating anchor point one (op_ap1) may be used with method 122 to change any quarter-rate ppp frame, for example, to a full-rate celp frame. If decision block 142 yields yes, for operating anchor point two (op_ap_2), the last frame is checked to see if it was also a quarter rate ppp frame method 122 may be used to change only one of the current quarter-rate ppp frame to a full-rate celp frame. A person of ordinary skill in the art will recognize that other methods used to select an encoding mode and/or encoding rate to be changed, such as method 120A, may be used with a method 122 or variant of method 122.

FIG. 10 is an exemplary illustration of pseudocode 143 that may implement a way to change encoding mode and/or encoding rate depending on operating anchor point, such as the combination of method 120A and method 122.

The selection of encoding mode and/or encoding rate may be modified by a later re-decision. FIG. 11 is an exemplary illustration of a method to determine an encoding decision (either an encoding mode or encoding rate) by an open loop re-decision or a closed loop re-decision. A result of an open loop (ol) re-decision and/or closed loop (cl) re-decision may be fed back, for example, to encoder controller 36 (see FIG. 2, FIG. 3 or FIG. 4). In FIG. 4, for example, an ol re-decision via an encoding rate/mode overrider 78, may change the encoding mode and/or encoding rate after pattern modifier 76 has already output an open loop encoding mode and encoding rate. Method 144, in FIG. 11, illustrates that in a first act a speech signal or a derivative of a speech signal may be acquired 145. In a next act 146, there is a representation of part or all of the derived speech signal's amplitude and phase components. In further acts 147 and 148, there is extraction of the amplitude and phase components. In yet a further act 149, an open loop re-decision and/or closed loop re-decision may be determined by using generated features derived from the speech signal from the current frame and a past frame.

The open loop re-decision and/or closed loop re-decision determination by using generated features149 may include a superset of rules and/or conditions based on various features from either the current frame and/or the past frame. The superset of rules may comprise a combination of a set of closed loop rules and a set of open loop rules. Features such as signal-to-noise ratio of any part of the current frame, residual energy ratio, speech energy ratio, energy of current frame, energy of a past frame, energy of predicted pitch prototype, predicted pitch prototype, prototype residual correlation, operating point average rate, lpc prediction gain, peak average of predicted pitch prototype (positive and/or negative), peak energy to average energy ratio. These features may be from current frames, past frames, and/or a combination of current and/or past frames. The features may be compressed (quantized) and/or uncompressed (unquantized). There may be variants and some or all of the features may be used to provide checks and/or rules such that a current waveform has not abruptly changed from the past waveform, i.e., a deviation of the current waveform from the past waveform is desired to be within various tolerances depending on used feature and/or rule.

FIG. 12 illustrates exemplary ways to acquire a speech signal or a signal derived from a speech signal and a way to represent the speech signal or derived speech signal by the signal's amplitude and phase components. Exemplary ways to acquire speech signal or a signal derived from a speech signal 145A may be to generate a residual signal 151 and modify the residual signal 152. The residual signal is derived from the speech signal. Generation of the residual signal may be done in the time domain, frequency domain, and/or the perceptually weighted domain. As an example of when the encoding mode is prototype pitch period (PPP), one way to represent the speech signal or derived speech signal into amplitude and phase components is to first extract the prototype pitch period from a waveform 154 (for example from the residual or modified residual described above) and then construct a prototype of the current frame's waveform. A speech prototype is typically derived from the entire frame, but is smaller than the frame.

PPP encoding exploits the periodicity of a speech signal to achieve lower bit rates than may be obtained using CELP coding. In general, PPP encoding involves extracting a representative period of the residual signal, referred to herein as the prototype residual, and then using that prototype to construct earlier pitch periods in the frame by interpolating between the prototype residual of the current frame and a similar pitch period from the previous frame (i.e., the prototype residual if the last frame was PPP). The effectiveness (in terms of lowered bit rate) of PPP encoding depends, in part, on how closely the current and previous prototype residuals resemble the intervening pitch periods. For this reason, PPP coding is preferably applied to speech signals that exhibit relatively high degrees of periodicity (e.g., voiced speech), referred to herein as quasi-periodic speech signals. An exemplary encoding of periodic speech technique is described in U.S. Pat. No. 6,456,964, entitled ENCODING OF PERIODIC SPEECH USING PROTOTYPE WAVEFORMS.

Representing a PPP prototype by amplitude and phase components 156 may be achieved by a number of ways. One such was is to compute a discrete fourier series (DFS) of the waveform 157. Obtaining amplitude components and phase components of a current frame by using a DFS (or analogous method) may capture the shape and energy of the prototype without depending on any past frame's information. As part of using the generated features derived from the past frames, restoring past fourier series 158 may take place by, for example, computing the previous PPP DFS from a set of values from the pitch memory (excitation memory), when the past frame was not a PPP encoded frame.

FIG. 13 illustrates a method, method 149A, for computing an open loop re-decision. An open-loop re-decision may be made, for example, based on a partial analysis of the frame. The current unquantized (or partially quantized) PPP waveform amplitude and phase components 170 are compared by generating and checking features 172 to the past waveform (quantized or unquantized) amplitude and phase components 174. As discussed above, unquantized may mean uncompressed and quantized may mean compressed. The past waveform amplitude and phase components 174 may be any one of an compressed amplitude components and compressed phase components 176, uncompressed amplitude components and uncompressed phase components 177, compressed amplitude components and uncompressed phase components 178, uncompressed amplitude components and compressed phase components 179. Such a generation and checking of features 172 may be based on a measure such as correlation in the residual or speech domain; SNR in the residual or speech domain; a comparison of peak-to-average ratio between the waveforms; and/or a determination of whether the pitch lags of the two waveforms are within a predetermined range (or tolerance) of each other; other features may be used (see illustration of set of rules below). Various levels of quantization are possible, and a decision may be made at more than one such level.

Exemplary rules and/or features follow for which an open loop re-decision may be decided. The numbers in the decision rules may vary from platform, device, and/or network. The features and rules below are intended to be examples of open loop re-decision features and rules, and are included for illustration of checking at least one feature with at least one or more rules in a set of decision rules. A person of ordinary skill in the art will recognize that many different rules may be constructed and the constants in the rules may vary from device, platform and/or network. In addition, the features illustrated should not limit the open loop re-decision, as a person of ordinary skill in the art of speech encoding recognizes that other features may be used. Features: residual energy ratio (res_en ratio), residual correlation (res_corr), speech energy ratio (sp_en_ratio), and noise suppressed snr (ns_snr) may be checked with at least one rule in a set of decision rules. As an example, if any of the rules below are true, an open loop re-decision indicates that a change in encoding mode PPP and encoding rate quarter rate may be changed to encoding mode CELP and encoding rate full.

Rule 1: If the frame length minus the last PL (where PL is related to the pitch lag) values from the pitch memory is less than negative 7.

Rule 2: If the frame length minus the last PL values from the pitch memory is greater than positive 8.

Rule 3: If the operating anchor point equals one or two, and
If ns_snr is less than 25 and res_en_ratio is greater than 5, AND res_corr is less than 0.65.

Rule 4: If ns_snr is greater than or equal to 25 and res_en_ratio is greater than 3, AND res_corr is less than 1.2

Rule 5: If the operating anchor point is equal to 1:
if ns_snr is less than 25 and res_en_ratio is less than 0.025
else if ns_snr is greater than or equal to 25, and res_en_ratio<0.075

Rule 6: If operating anchor point equals 2, and
if ns_snr is less than 25, and res_en_ratio is less than 0.025
else if ns_snr is greater than or equal to 25 and res_en_ratio is less than 0.075
else if ns_snr is greater than or equal to 25, and res_corr is less than 0.5, and the minimum between res_en_ratio and sp_en_ratio is less than 0.075

Rule 7: If the operating anchor points are equal to one or two and
if the ns_snr is less than 25 and res_en_ratio is greater than 14.5
else if ns_snr is greater than or equal to 25 and res_en_ratio is greater than 7

Rule 8: If the operating anchor point equals 2
If the ns_snr is greater than or equal to 25, and res_corr is less than or equal to zero Rule 9: If the previous frame was quarter-rate NELP or silence.

FIG. 14 illustrates a method, method 149B, for computing a closed loop re-decision. Increased flexibility of a multi-mode, variable rate encoder may be achieved by implementing a closed loop re-decision process. In one aspect the closed loop re-decision process may work with the open-loop re-decision process in that a reconstructed waveform, originally compressed according to the decision made by the open-loop decision (or re-decision) process, may be compared to the speech signal or derived speech signal. If the comparison is unfavorable, i.e., an error parameter is greater than a predetermined threshold, then the speech encoder may be directed to use different encoding modes and/or encoding rates to compress the original input frame again. One mechanism for performing this re-compression is to change an operating anchor point used in the open loop decision process, or alternatively, to change one or more thresholds in the algorithms for differentiating different types of speech.

In another aspect, a closed-loop re-decision may work in stages to perform quantization of amplitude components and phase components of the current frame. In stage 1, the amplitude components or phase components may be compressed. For example, in method 149B the amplitude components are compressed and the phase components are left uncompressed 180 in stage 1. The compressed amplitude components of the current frame may be compared to any of the amplitude components of the past frame 174. At least one feature and at least one rule in a set of decision rules may be used to determine closed loop re-decision. As an example for a feature, consider grouping a subset of compressed amplitude components and computing an average for each group. This may be done for the current frame and past frame. The difference or absolute value of the difference or square of the difference or any other variant of the difference may be computed between the average for each group in the current and past frame. If this feature is greater than a constant, K1, and the difference between a target amplitude in the current frame and the target amplitude in the past frame is greater than a constant, K2 then for example, quarter rate PPP processing may be abandoned and the encoding mode changed to CELP and the encoding rate changed to full-rate. A person of ordinary skill in the art will recognize that variants of the features implicitly may lead to variant on the rules. Depending on the feature a different rule may be used. For example, K1 and K2 may be different for each feature and thus lead to a different rule or set of rules.

FIG. 15 illustrates a method, method 149C, for computing a closed loop re-decision. Method 149C may be considered as a stage 2, where the amplitude components and phase components of a current frame may be compressed. As in stage 1, the compressed amplitude components of the current frame may be compared to any of the amplitude components of the past frame 174. In addition, the compressed phase components of the current frame may be compared to any of the phase components of the past frame 174. In general, compressed amplitude and phase components of a current frame may be compared with any of the amplitude and phase components (compressed or uncompressed) of a past frame. At least one feature and at least one rule in a set of decision rules may be used to determine closed loop re-decision in stage 2. Because both amplitude and phase components in the current frame are compressed in stage 2, the number of features to choose from may be larger. Features already mentioned above, such as signal-to-noise ratio of any part of the current frame, residual energy ratio, speech energy ratio, energy of current frame, energy of a past frame, energy of predicted pitch prototype, predicted pitch prototype, prototype residual correlation, operating point average rate, lpc prediction gain, peak average of predicted pitch prototype (positive and/or negative), peak energy to average energy ratio. These features may be from current frames, past frames, and/or a combination of current and/or past frames. The features may be compressed (quantized) and/or uncompressed (unquantized). There may be variants and some or all of the features may be used to provide checks and/or rules such that a current waveform has not abruptly changed from the past waveform, i.e., a deviation of the current waveform from the past waveform is desired to be within various tolerances depending on used feature and/or rule.

FIG. 16 illustrates an exemplary flowchart for the possible decisions that may be made for encoding mode and/or encoding rate based on aspects described herein. Once the input frame is classified as one of various types of speech (which may include transient, beginning of words (up transients), ends of words (down transients), stationary voiced, non-stationary voiced, unvoiced, and silence/background noise) the encoding rate and encoding mode is chosen. For fast changes, it may be desired to use CELP, as PPP may be unreliable for such a signal. It may also be desirable to use a higher rate when there is no past, and to use a lower rate at the end of a word (e.g. speech trailing off, low in volume). For unstructured signals, CELP may be selected. For noisy signals, NELP may be used, and the rate may be selected based on whether the signal is silence or unvoiced speech. For voiced speech, CELP or PPP may be selected. CELP is a general-purpose mode, while PPP is generally better able to exploit the redundancy and/or periodicity in voiced speech. PPP may also provide better performance against error propagation. It may be desired to use PPP only for voiced signals. If the waveform is very stationary, then a memoried mode of PPP may be selected, in which past information (such as one or more previous prototypes) may be applied to parameterize, quantize or compress, or synthesize the current information. If the waveform is not stationary, then a memoryless form of PPP may be used, where the parameters of the prototype or their compression or quantization may not depend on the past. Memoryless PPP may also be selected based on a desire to limit error propagation. A general scheme for choosing the encoding rate and encoding mode follows. If a frame is transient or is at a beginning or end of a word, the coding model used is CELP. This type of coding model is generally not dependent on what's in the frame, since CELP tries to match waveforms. Additionally, within CELP, the rate used is higher (e.g. full-rate) when the frame is a transient and/or beginning of a word, whereas the rate used is lower (e.g. half-rate) when the frame is an end of a word. Ends of words usually have lesser information and are also temporally masked by the preceding high energy/high information frames. If a frame is unvoiced or silence/background noise, the coding model used is NELP. This type of frame typically has very little information and is similar to noise shaped by a spectrum and an energy envelope. Higher rate NELP (e.g., half-rate or quarter-rate) may be used for unvoiced frames and lower rate NELP (eighth-rate) for silence/background noise frames. Unvoiced active speech frames usually carry more information than silence or background noise frames. If a frame is voiced, either CELP or PPP can be used. CELP can handle voiced frames by matching waveforms as for any other frame. However, rarely is this property of CELP needed in the perceptual sense, since there is a lot of redundancy in a voiced frame due to periodicity. For nearly the same quality and performance, PPP can be lower in bit-rate. For the same bit-rate and quality, PPP may also be better in erasure propagation performance. Thus, if a frame is non-stationary voiced, there is a choice of PPP or CELP, depending on the degree of non-stationarity, erasure performance, etc. Higher bit-rates are typically used for non-stationary voiced (e.g., full-rate). On the other hand, if the frame is stationary voiced, PPP may be a better choice, since it can help in reducing the bit-rate. Hence, lower bit-rates are employed for stationary voiced (e.g., quarter-rate or half-rate). In one such configuration, the encoding mode is selected from among at least one memoryless encoding mode of PPP and at least one encoding mode of PPP that incorporates memory, the selection being based on a measure of stationariness of voiced speech in the frame. The selections of encoding mode and/or encoding rate may be overridden due to employment of one or more of: rate patterns (which may be predetermined), rate control to achieve a target bit-rate, re-adjusting to an adaptive or pre-determined ratio of rates, open-loop mode re-decision, and/or closed-loop mode re-decision. Methods of comparisons that may be applied in open-loop and/or closed-loop re-decision procedures were described in greater detail previously.

FIG. 17 is an exemplary illustration of pseudocode 190 that may implement a way to change encoding mode and/or encoding rate depending on operating anchor point or open loop re-decision or closed loop re-decision. Pseudocode 190 is similar to pseudocode 143, except that for operating anchor point 1 and operating anchor point 2 open and closed loop re-decisions may be taken into account when modifying the pattern.

A number of different configurations/techniques have been described. The configurations/techniques may be capable of improving speech encoding by improving encoding mode and encoding rate selection at arbitrary target bit rates through open loop re-decision and/or closed loop re-decision. The configurations/techniques may be implemented in hardware, software, firmware, or any combination thereof. If implemented in software, the configurations/techniques may be directed to a computer readable medium comprising program code, that when executed in a device that encodes speech frames, performs one or more of the methods mentioned above. In that case, the computer readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, and the like.

The program code may be stored on memory in the form of computer readable instructions. In that case, a processor such as a DSP may execute instructions stored in memory in order to carry out one or more of the configurations/techniques described herein. In some cases, the techniques may be executed by a DSP that invokes various hardware components such as a motion estimator to accelerate the encoding process. In other cases, the speech encoder may be implemented in a microprocessor, general purpose processor, or one or more application specific integrated circuits (ASICs), one or more field programmable gate arrays (FPGAs), or some other hardware-software combination. These and other configurations/techniques are within the scope of the following claims.

The invention claimed is:

1. A method comprising:

representing, by using a processing device, a speech signal by amplitude components and phase components for a current frame and a past frame;

in a first closed loop stage, generating a first set of compressed components and a first set of uncompressed components for the current frame;

retrieving the amplitude components and the phase components from the past frame;

generating a first set of features based on the first set of compressed components, the first set of uncompressed components, the amplitude components from the past frame, and the phase components from the past frame;

checking the first set of features as part of a closed loop re-decision;

determining a final encoding decision based on the checking; and encoding the speech signal based on the final encoding decision.

2. The method of claim 1, further comprising, in a second closed loop stage, generating a second set of compressed components for the current frame by compressing the first set of uncompressed components and generating a second set of features based on the first compressed set of compressed components, the second set of compressed components, the amplitude components from the past frame, and the phase components from the past frame.

3. The method of claim 2, wherein the checking further comprises checking the second set of features as part of the closed loop re-decision.

4. The method of claim 1, wherein the final encoding decision indicates an encoding mode.

5. The method of claim 4, wherein the encoding mode changes from PPP to CELP.

6. The method of claim 4, wherein the final encoding decision indicates an encoding rate.

7. The method of claim 6, wherein the encoding rate changes from quarter to full.

8. The method of claim 6, wherein the encoding rate changes from half to full.

9. The method of claim 1, wherein the generating the first set of features further comprises calculating at least one energy ratio, at least one signal to noise-ratio and calculating at least one correlation.

10. The method of claim 9, wherein the at least one energy ratio further comprises at least one energy ratio calculated in the time domain, frequency domain, or perceptually weighted domain.

11. The method of claim 10, wherein the at least one energy ratio is calculated from a derived signal from the speech signal.

12. The method of claim 9, wherein the derived signal is a residual signal.

13. The method of claim 1, wherein the amplitude components from the past frame are compressed and the phase components from the past frame are compressed.

14. The method of claim 1, wherein the amplitude components from the past frame are uncompressed and the phase components from the past frame are uncompressed.

15. The method of claim 1, wherein the amplitude components from the past frame are compressed and the phase components from the past frame are uncompressed.

16. The method of claim 1, wherein the amplitude components from the past frame are uncompressed and the phase components from the past frame are compressed.

17. The method of claim 1, wherein the representing a speech signal by amplitude and phase components comprises calculating a fourier series and extracting real and imaginary parts of the fourier series to calculate the amplitude components and the phase components.

18. The method of claim 1, wherein checking the first set features further comprises checking at least one feature with at least one or more rules in a set of decision rules.

19. A non-transitory computer-readable storage medium comprising instructions that, when executed by one or more processors, cause the one or more processors to:

represent a speech signal by amplitude components and phase components for a current frame and a past frame;

in a first closed loop stage generate a first set of compressed components and a first set of uncompressed components for a current frame;

retrieve the amplitude components and the phase components from the past frame;

generate a first set of features based on the first set of compressed components, the first set of uncompressed components, the amplitude components from the past frame, and the phase components from the past frame;

check the first set of features as part of a closed loop re-decision;

determine a final encoding decision based on the checking; and encode the speech signal based on the final encoding decision.

20. The non-transitory computer-readable storage medium of claim 19, further comprising instructions that, when executed by the one or more processors, cause the one or more processors to:

in a second closed loop stage, generate a second set of compressed components for the current frame by compressing the first set of uncompressed components; and generate a second set of features based on the first compressed set of compressed components, the second set of compressed components, the amplitude components from the past frame, and the phase components from the past frame.

21. The non-transitory computer-readable storage medium of claim 20, wherein the final encoding decision is an encoding mode.

22. The non-transitory computer-readable storage medium of claim 21, wherein the encoding mode changes from PPP to CELP.

23. The non-transitory computer-readable storage medium of claim 20, wherein generating the second set of features further comprises calculating at least one energy ratio, calculating at least one signal to noise-ratio, and calculating at least one correlation.

24. The non-transitory computer-readable storage medium of claim 19, wherein the final encoding decision is an encoding rate.

25. The non-transitory computer-readable storage medium of claim 24, wherein the encoding rate changes from quarter to full.

26. The non-transitory computer-readable storage medium of claim 24, wherein the encoding rate changes from half to full.

27. The non-transitory computer-readable storage medium of claim 19, wherein generating the first set of features further comprises calculating at least one energy ratio, calculating at least one signal to noise-ratio, and calculating at least one correlation.

28. An apparatus comprising an array of logic elements configured to perform a method according to any of claims 1 to 18.

29. A mobile device comprising:

circuitry configured to interact with a network for radio-frequency communications; and a non-transitory computer-readable storage medium comprising instructions that, when executed by one or more processors, cause the one or more processors to:

represent a speech signal by amplitude components and phase components for a current frame and a past frame;

in a first closed loop stage, generate a first set of compressed components and a first set of uncompressed components for a current frame;

retrieve the amplitude components and the phase components from the past frame;

generate a first set of features based on the first set of compressed components, the first set of uncompressed components, the amplitude components from the past frame, and the phase components from the past frame;

check the first set of features as part of a closed loop re-decision;

determine a final encoding decision based on the checking, wherein the final encoding decision identifies an encoding rate, wherein the encoding rate changes from half to full; and encode the speech signal based on the final encoding decision.

30. A device comprising:

a processing device, and a memory means for representing a speech signal by amplitude components and phase components for a current frame and a past frame;

in a first closed loop stage, means for generating a first set of compressed components and a first set of uncompressed components for a current frame;

means for retrieving the amplitude components and the phase components from the past frame;

means for generating a first set of features based on the first set of compressed components, the first set of uncompressed components, the amplitude components from the past frame, and the phase components from the past frame;

means for checking the first set of features as part of a closed loop re-decision; and means for determining a final encoding decision based on the checking.

31. The device of claim 30, further comprising, in a second closed loop stage, means for generating a second set of compressed components for the current frame by compressing the first set of uncompressed components and generating a second set of features based on the first compressed set of compressed components, the second set of compressed components, the amplitude components from the past frame, and the phase components from the past frame.

32. The device of claim 31, wherein generating the second set of features further comprises calculating at least one energy ratio, calculating at least one signal to noise-ratio, and calculating at least one correlation.

33. The device of claim 31, wherein the means for checking the second set of features further comprises means for checking at least one feature with at least one or more rules in a set of decision rules.

34. The device of claim 30, wherein the final encoding decision indicates an encoding mode.

35. The device of claim 30, wherein the encoding mode changes from PPP to CELP.

36. The device claim 30, wherein the final encoding decision indicates an encoding rate.

37. The device claim 36, wherein the encoding rate changes from quarter to full.

38. The device of claim 36, wherein the encoding rate changes from half to full.

39. The device of claim 30, wherein the means for generating the first set of features further comprises calculating at least one energy ratio, calculating at least one signal to noise-ratio, and calculating at least one correlation.

40. The device of claim 30, wherein the device is a mobile device comprising circuitry configured to interact with a network for cellular radio-frequency communications.

41. The device of claim 30, wherein the amplitude components from the past frame are compressed and the phase components from the past frame are compressed.

42. The device of claim 30, wherein the amplitude components from the past frame are uncompressed and the phase components from the past frame are uncompressed.

43. The device of claim 30, wherein the amplitude components from the past frame are compressed and the phase components from the past frame are uncompressed.

44. The device of claim 30, wherein the amplitude components from the past frame are uncompressed and the phase components from the past frame are compressed.

45. The device of claim 30, wherein the means for representing a speech signal by amplitude and phase components comprises means for calculating a fourier series and means for extracting real and imaginary parts of the fourier series to calculate the amplitude components and the phase components.

46. The device of claim 30, wherein the means for checking the first set of features further comprises means for checking at least one feature with at least one or more rules in a set of decision rules.

* * * * *